US005784005A

United States Patent [19]

Akutsu et al.

[11] Patent Number: 5,784,005

[45] Date of Patent: Jul. 21, 1998

[54] COMMUNICATIONS INFRASTURCTURE SYSTEM FOR VEHICLES

[75] Inventors: Eisaku Akutsu, Susono; Kenji Sasaki, Gotenba; Keiji Aoki, Susono, all of Japan

[73] Assignee: Toyota Jidosha Kabushiki Kaisha, Toyota, Japan

[21] Appl. No.: 512,320

[22] Filed: Aug. 8, 1995

[30] Foreign Application Priority Data

Aug. 31, 1994 [JP] Japan ..... 6-207221

[51] Int. Cl.[6] ..... G08G 1/09

[52] U.S. Cl. ..... 340/905; 340/991; 701/117; 455/54.1

[58] Field of Search ..... 340/905, 991, 340/993, 988; 764/436; 455/54.1; 701/117

[56] References Cited

U.S. PATENT DOCUMENTS

| | | | |
|---|---|---|---|
| 4,002,983 | 1/1977 | Kavalir et al. | 455/56.1 |
| 4,229,724 | 10/1980 | Marcus | 340/988 |
| 4,962,457 | 10/1990 | Chen et al. | 340/905 |
| 5,289,183 | 2/1994 | Hassett et al. | 340/905 |
| 5,444,742 | 8/1995 | Grabow et al. | 340/905 |

FOREIGN PATENT DOCUMENTS

| | | |
|---|---|---|
| B-2460008 | 7/1975 | European Pat. Off. . |
| A-0058596 | 8/1982 | European Pat. Off. . |
| A-0136691 | 4/1985 | European Pat. Off. . |
| A-2223869 | 4/1990 | European Pat. Off. . |
| A-0506353 | 9/1992 | European Pat. Off. . |
| 62-261981 | 11/1987 | Japan . |
| 4-3300 | 1/1992 | Japan . |
| 4-148500 | 5/1992 | Japan . |
| 4-212080 | 8/1992 | Japan . |
| 6-60293 | 3/1994 | Japan . |

OTHER PUBLICATIONS

Patent Abstracts of Japan, vol. 18, No. 300 (P-1750), Jun. 8, 1994 & JP-A-06 060 293 (MEITEC), Mar. 4, 1994.

*Primary Examiner*—Edward Lefkowitz
*Attorney, Agent, or Firm*—Kenyon & Kenyon

[57] ABSTRACT

A communications infrastructure system for vehicles. The communications infrastructure system includes an infrastructure including a plurality of beacons sequentially positioned along a road wherein the beacons transmit respective ones of a repeated series of at least three kinds of signals. The communications infrastructure system also includes a communications apparatus provided with a vehicle, which communications apparatus comprises a receiver for receiving a signal transmitted by the beacons, a unit for discriminating the kind of signal, a memory for recording a past record of the kind of signal, and a signal generator generating a signal corresponding to the past record.

22 Claims, 25 Drawing Sheets

COMMUNICATIONS INFRASTURCTURE SYSTEM FOR VEHICLES

BACKGROUND OF THE INVENTION (1) Field of the Invention

The present invention generally relates to a communications infrastructure system for vehicles and, more particularly, to a communications system for communicating accident information between a vehicle and an infrastructure.

(2) Description of the Related Art

Conventionally, several systems for communications between vehicles and an infrastructure have been proposed. The communications systems are useful to rapidly inform an administration center of a traffic accident occurrence. Particularly, in a case where a person involved in the traffic accident cannot personally ask for help, the system is very useful in providing a quick response.

In order to respond to a traffic accident, it is necessary to accurately detect the position of the accident. To satisfy this necessity, an apparatus for detecting the position of a vehicle involved in the accident may be provided. As an apparatus for detecting the position of the vehicle, a navigation apparatus using the Global Positioning System (GPS) is known as disclosed in Japanese Laid-open Patent Application No. 6-60293.

Therefore, when a communications system includes the navigation apparatus provided with each vehicle, it is possible for each vehicle to be identified by position and transmit signals corresponding to this position when a traffic accident involves the vehicle or occurs near the vehicle. Thus, according to the system, it is possible to immediately detect the position of the accident.

On a road having a median strip, it is difficult for a vehicle to move from a lane in which traffic moves in a predetermined direction—hereinafter, called an "up lane"—to a lane in which traffic moves in a direction opposite to the up lane—hereinafter, called a "down lane". When a traffic accident occurs on such a road, it is desirable to take immediate action with respect to the accident, after detecting the exact position of the accident and identifying the lane in which the accident has occurred as an up lane or a down lane. However, the navigation apparatus using the GPS can detect only the position of the vehicle, i.e., the latitude and the longitude of the vehicle. Thus, it is not possible to identify the lane of the vehicle as an up lane or a down lane from the information received by the navigation apparatus. Further, the navigation apparatus is so expensive that it is difficult to construct at low cost. For this reason, the communications system using the navigation apparatus may not be the best possible communications system used on a road having a median strip such as a highway.

On the other hand, when beacons are placed along both lanes of a highway, respectively, as a part of the highway infrastructure, and the vehicles in the respective lanes communicate to the beacons placed along the respective lanes, it is possible to identify the lane of a vehicle transmitting a signal. However, a huge cost is necessary to place the beacons along both lanes of the highway. Therefore, it has been difficult to construct this communications system for practical use.

SUMMARY OF THE INVENTION

It is a general object of the present invention to provide a novel and useful communications infrastructure system for vehicles and a novel and useful communications apparatus thereof.

A more specific object of the present invention is to provide a communications infrastructure system for vehicles by which a lane in which a vehicle is located can be identified as an up lane or a down lane.

A further object of the present invention is to provide an infrastructure used in the communications infrastructure system which provides signals by which a vehicle on the road identifies a lane in which the vehicle is located as an up lane or a down lane.

A further object of the present invention is to provide a communications apparatus provided with a vehicle which generates signals corresponding to the lane in which the vehicle is located.

The above-mentioned objects of the present invention are achieved by a communications infrastructure system for vehicles. Included therein is a plurality of beacons sequentially positioned along a road wherein the sequentially positioned beacons transmit respective ones of a repeated series of at least three kinds of signals, a receiver provided on a vehicle which receives signals transmitted from the beacons, a signal discrimination unit which discriminates between the at least three kinds of signals received by the receiver, a past record memory which records a past record of the discrimination results of the signal discrimination unit, and a signal generator for generating a signal corresponding to the past records recorded in the past record memory.

The above-mentioned objects of the present invention are also achieved by an infrastructure for the communications infrastructure system comprising a plurality of beacons sequentially positioned along a road, and a signal controller which controls the plurality of beacons to transmit respective ones of a repeated series of at least three kinds of signals.

The above-mentioned objects of the present invention are also achieved by a communications apparatus for a vehicle. Included therein is a receiver for receiving signals transmitted from a plurality of beacons, a signal discrimination unit which discriminates between kinds of signals received by the receiver, a past record memory which records a past record of the discrimination result of the signal discrimination unit, and a signal generator for generating a signal corresponding to the past records recorded in the past record memory.

In the communications infrastructure system of the present invention, the infrastructure transmits via the beacons sequentially positioned along the road a repeated series of at least three kinds of signals, in turn, along the road. Thus, the receiver provided with a vehicle moving along the road receives the repeated series of the three kinds of signals. In this case, the transition between the kinds of signals corresponds to a moving direction of the vehicle. The kinds of signals are discriminated by the signal discrimination unit and recorded in the past record memory of the communications apparatus. Therefore, the signal generated by the signal generator corresponds to a moving direction of the vehicle. Hence, according to this communications infrastructure system, it is possible to identify the lane of the vehicle as an up lane or a down lane.

Other objects, features and advantages of the present invention will become more apparent from the following detailed description when read in conjunction with the accompanying drawings.

DESCRIPTION OF THE PREFERRED EMBODIMENTS

Figure 1:
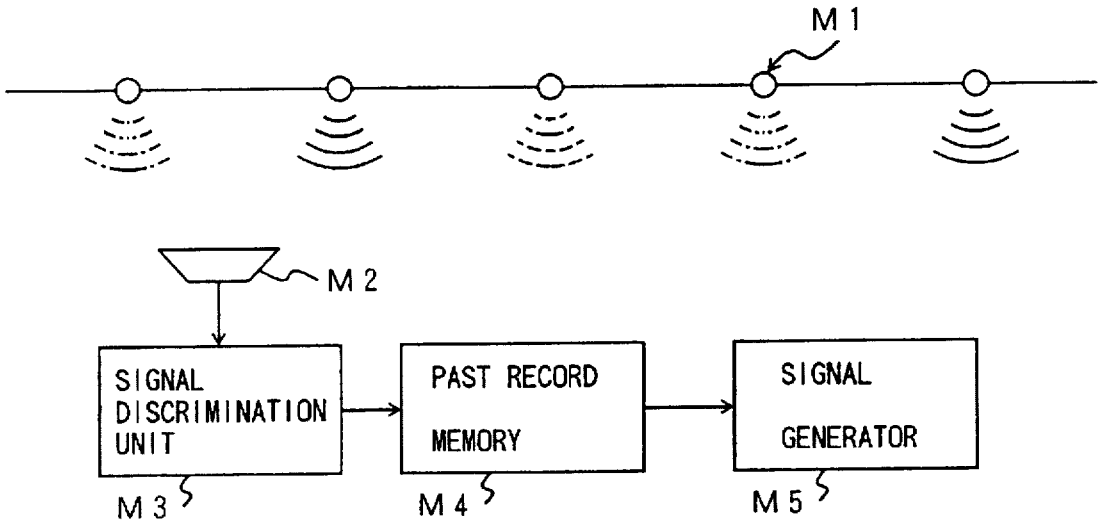
FIG. 1 is a block diagram of a first principle of a communications infrastructure system for a vehicle according to the present invention.

First, a description will be given, with reference to FIG. 1 through FIG. 7, of principles of the present invention. FIG. 1 is a block diagram of a first principle of a communications infrastructure system for a vehicle according to the present invention.

The communications infrastructure system according to the present invention comprises an infrastructure including a plurality of beacons M1 sequentially placed along a road wherein the sequentially placed beacons transmit respective ones of a repeated series of at least three kinds of signals. A communications apparatus provided with a vehicle includes a receiver M2 for receiving signals transmitted from the beacons M1, a signal discrimination unit M3 which discriminates the kinds of signals received by the receiver M2, a past record memory M4 for recording a past record of the discrimination results of the signal discrimination unit M3, and a signal generator M5 for generating a signal corresponding to the past records recorded in the past record memory M4.

As discussed above, the sequentially placed beacons M1 transmit respective ones of the repeated series of at least three kinds of signals along the road. The receiver M2 provided with a vehicle moving along the road receives the transmitted signals. The transition between the kinds of signals corresponds to a moving direction of the vehicle. The kinds of signals are discriminated by the signal discrimination unit M3 and recorded in the past record memory M4. The signal generator M5 provides a signal which corresponds to a moving direction of the vehicle. Hence, according to the system discussed above, it is possible to identify the lane in which the vehicle is moving as an up lane or a down lane.

Figure 2:
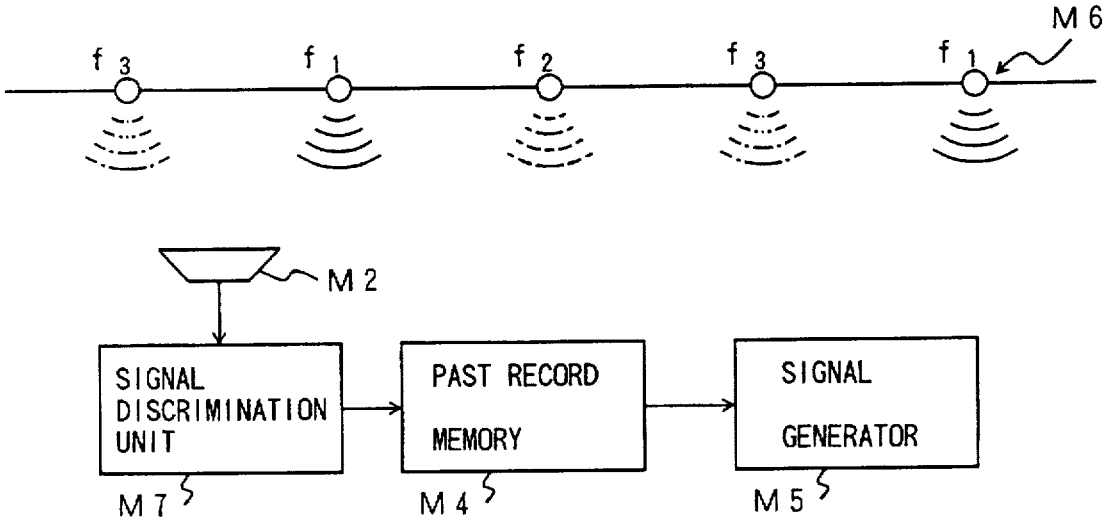
FIG. 2 is a block diagram of a second principle of the communications infrastructure system for a vehicle according to the present invention.

FIG. 2 is a block diagram of a second principle of the present invention in which further features are added to the first principle shown in FIG. 1. In FIG. 2, those parts that are the same as the ones shown in FIG. 1 are given the same reference numbers, and a description thereof will be omitted.

The communications infrastructure system according to the second principle of the present invention includes an infrastructure comprising a plurality of beacons M6 sequentially placed along a road. The beacons M6 transmit respective ones of a repeated series of at least three kinds of signals, each kind of signal having a different frequency. The communications infrastructure system also includes a communications apparatus having a signal discrimination unit M7. The signal discrimination unit M7 discriminates the kind of signal received by the receiver M2 based on the frequency thereof. According to the communications infrastructure system shown in FIG. 2, the signal is easily discriminated based on the frequency of the signal. Therefore, the communications infrastructure system is of a simple construction.

Figure 3:
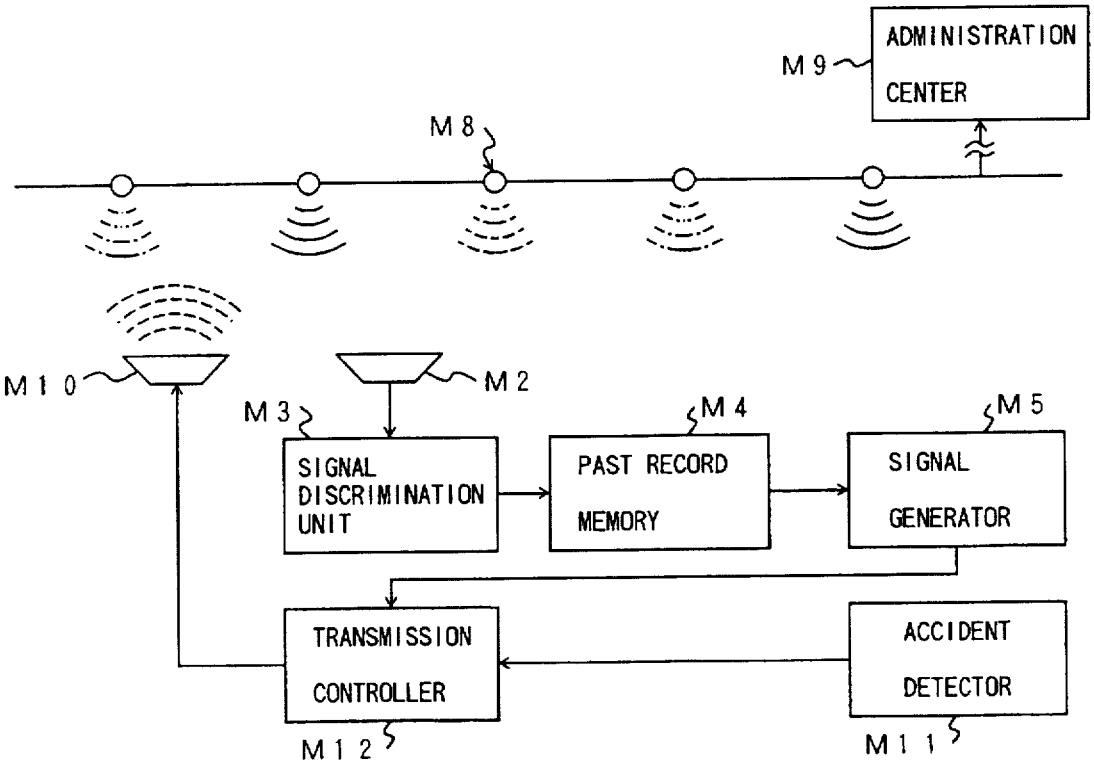
FIG. 3 is a block diagram of a third principle of the communications infrastructure system for a vehicle according to the present invention.

FIG. 3 is a block diagram of a third principle of the present invention in which further features are added to the first principle shown in FIG. 1. In FIG. 3, those parts that are the same as the ones shown in FIG. 1 are given the same reference numbers, and a description thereof will be omitted.

The communications infrastructure system according to the third principle of the present invention includes an infrastructure comprising a plurality of beacons M8 sequentially placed along a road and an administration center M9. The beacons M8 transmit respective ones of a repeated series of at least three kinds of signals. Further, the beacons M8 receive predetermined signals and relay the signals to the administration center M9. The communications infrastructure system also includes a communications apparatus having a transmitter M10, an accident detector M11 and a transmission controller M12. The transmitter M10 transmits a predetermined signal. The accident detector M11 detects the occurrence of an accident involving the vehicle. The transmission controller M12 controls the transmitter M10 to transmit the signal generated by the signal generator M5 when an accident is detected by the accident detector M11.

When a vehicle is involved in an accident, the occurrence of the accident is immediately detected by the accident detector M11. As a result, the signal generated by the signal generator M5, namely, the signal corresponding to the moving direction of the vehicle, is transmitted from the transmitter M10. The signal transmitted from the transmitter M10 is received by the beacons M8 positioned near the vehicle and further relayed to the administration center M9. Thus, information including the moving direction of the vehicle prior to the accident is immediately supplied to the administration center M9 after the occurrence of the accident. Therefore, the lane in which the accident has occurred is immediately identified as an up lane or a down lane at the administration center M9.

Figure 4:
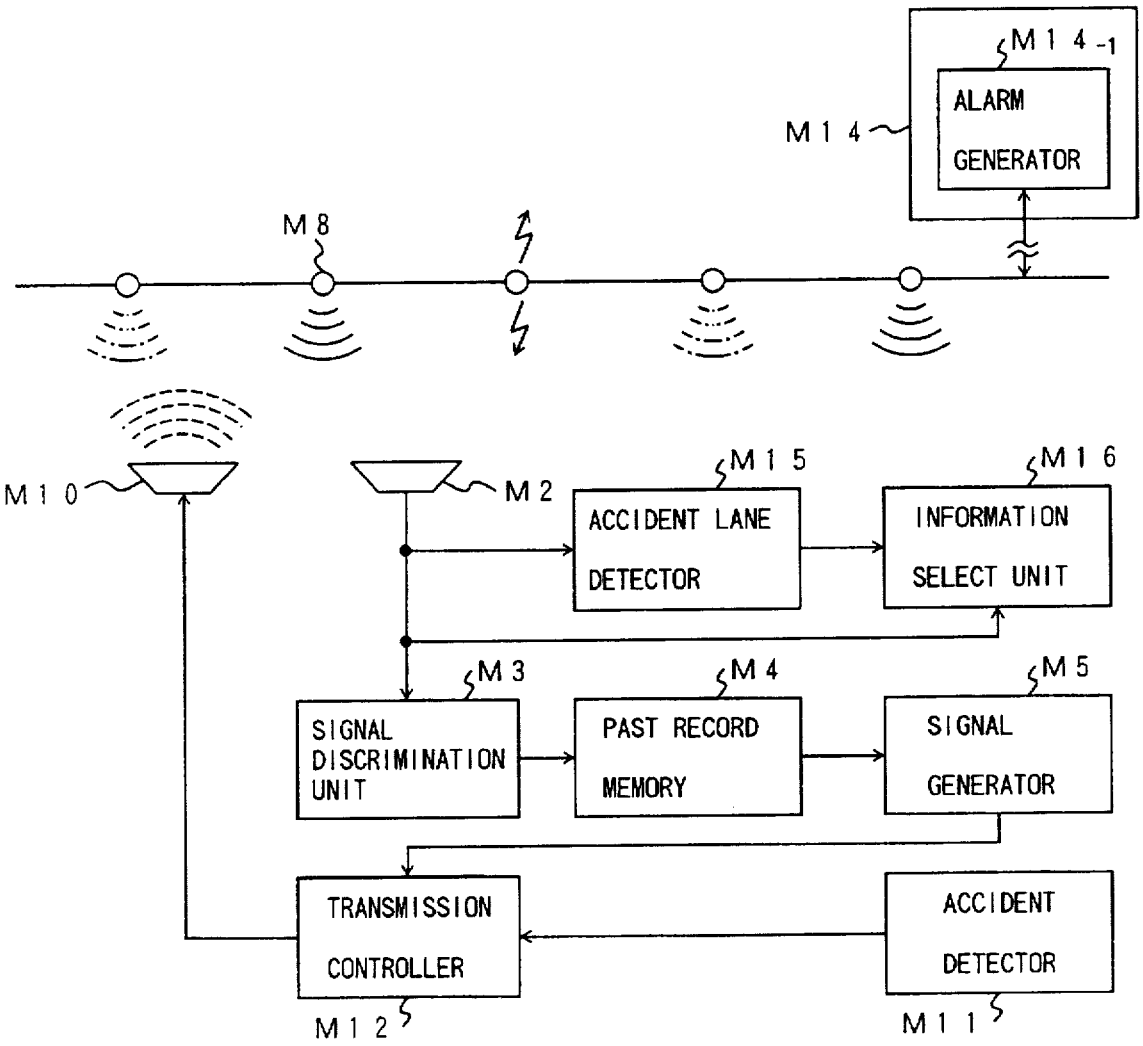
FIG. 4 is a block diagram of a fourth principle of the communications infrastructure system for a vehicle according to the present invention.

FIG. 4 is a block diagram of a fourth principle of the present invention in which further features are added to the third principle shown in FIG. 3. In FIG. 4, those parts that are the same as the ones shown in FIG. 3 are given the same reference numbers, and a description thereof will be omitted.

The communications infrastructure system according to the fourth principle of the present invention includes an infrastructure having an administration center M14. The administration center M14 has an alarm generator $M14_{-1}$. The alarm generator $M14_{-1}$ discriminates the position of the accident and the lane in which the accident has occurred, and then generates an alarm signal including information of the accident when the signal transmitted from the transmitter M10 is relayed by the beacons M8. The administration center M14 instructs one of the beacons M8, which beacon is adjacent to the lane in which the accident has occurred, to transmit the alarm signal. The communications infrastructure system also includes a communications apparatus having an accident lane detector M15 and an information select unit M16. The accident lane detector M15 determines whether the lane in which the accident has occurred is an up lane or a down lane by using the alarm signal transmitted from one of the beacons M8 and supplies the determination to the information select unit M16. The information select unit M16 accepts the alarm signal as accident information when the lane in which the accident has occurred is the same lane as that which the vehicle provided with the communication apparatus is moving.

According to the communications infrastructure system shown in FIG. 4, the alarm signal is transmitted from one of the beacons M8 to vehicles moving along the up lane and the down lane. Thus, the alarm signal is received by not only vehicles moving in a lane in which the accident has occurred but also vehicles moving in a lane in which the accident has not occurred. On the other hand, it is determined by each vehicle whether or not the alarm signal is information about an accident which occurred in the lane in which the vehicle is traveling, based on the detection result of the accident lane detector M15. Thus, the alarm signal is accepted as accident information by vehicles in the lane in which the accident occurred and not accepted by vehicles in the other lane. Moreover, the alarm signal is transmitted by one of the beacons M8 positioned along the road at a location a distance in back of the accident scene. The alarm signal is not received by vehicles moving away from the accident scene. Therefore, the alarm signal is received by vehicles traveling in the lane in which the accident has occurred, which vehicles are moving toward the accident scene only.

Figure 5:
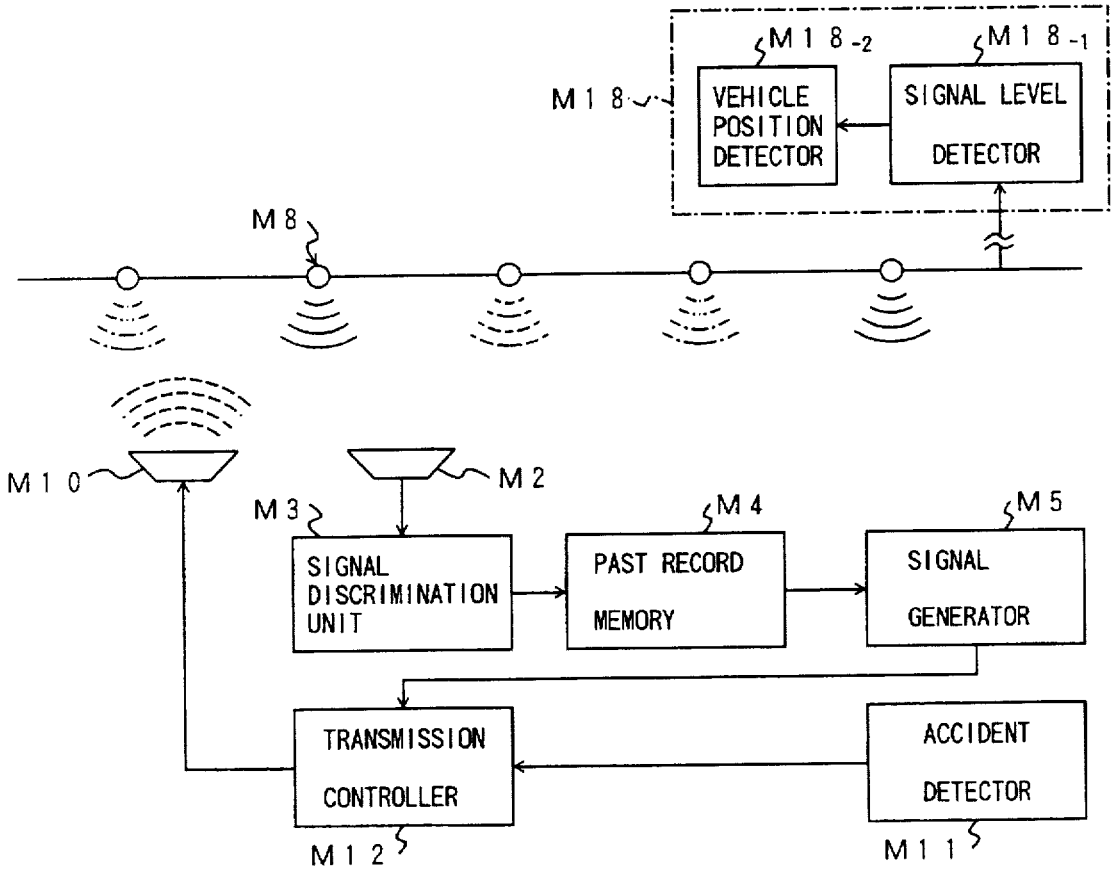
FIG. 5 is a block diagram of a fifth principle of the communications infrastructure system for a vehicle according to the present invention.

FIG. 5 is a block diagram of a fifth principle of the present invention in which further features are added to the third principle shown in FIG. 3. In FIG. 5, those parts that are the same as the ones shown in FIG. 3 are given the same reference numbers, and a description thereof will be omitted.

The communications infrastructure system according to the fifth principle of the present invention includes a infrastructure having an administration center M18. The administration center M18 has a signal level detector $M18_{-1}$ and a vehicle position detector $M18_{-2}$. The signal level detector $M18_{-1}$ detects the intensity of each signal transmitted from the beacons M8. The vehicle position detector $M18_{-2}$ detects the position of the vehicle from the positions of the beacons sending the signal to the administration center M18. The intensity of each signal is detected by the signal level detector $M18_{-1}$.

According to the communications infrastructure system shown in FIG. 5, when the signal transmitted from a vehicle is received by one of the beacons M8, it can be considered that the vehicle's position is near the beacon which received the signal. On the other hand when the signal transmitted from a vehicle is received by a plurality of beacons, it can be considered that the vehicle is positioned between the beacons which received the signal. In a case where the signal transmitted from a vehicle is received by a plurality of beacons, the intensity of the signal received by each beacon corresponds to a distance between the beacon and the vehicle. Thus, the position of the vehicle can be exactly detected by comparing the intensity of each of the signals received by the plurality of beacons.

Figure 6:
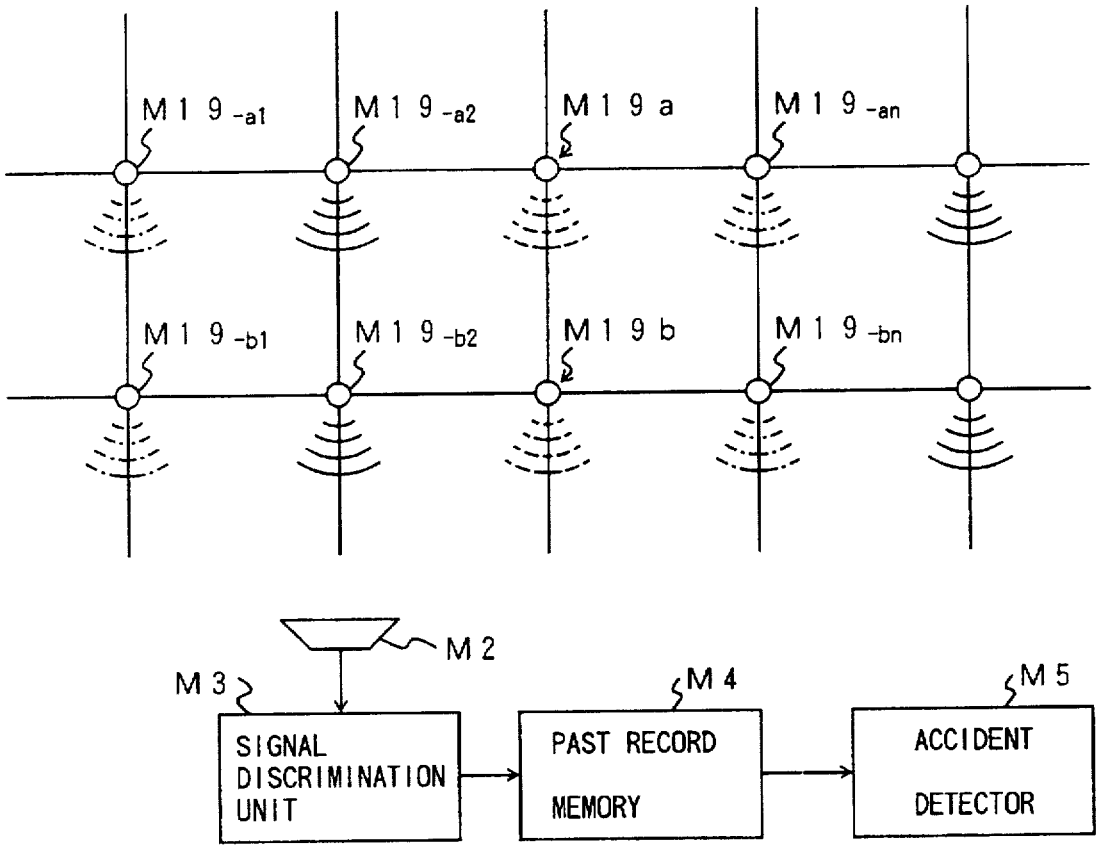
FIG. 6 is a block diagram of a sixth principle of the communications infrastructure system for a vehicle according to the present invention.

FIG. 6 is a block diagram of a sixth principle of the present invention in which further features are added to the first principle shown in FIG. 1. In FIG. 6, those parts that are the same as the ones shown in FIG. 1 are given the same reference numbers, and a description thereof will be omitted.

The communications infrastructure system according to the sixth principle of the present invention includes an infrastructure for a two-dimensional road system having intersections. The infrastructure includes a plurality of beacons M19*a* and M19*b* placed along a plurality of roads so that at least three kinds of signals are repeatedly transmitted.

in turn, along the roads. According to the communications infrastructure system, the position of the accident scene and the lane in which an accident has occurred can be detected in the two-dimensional road system.

Figure 7:
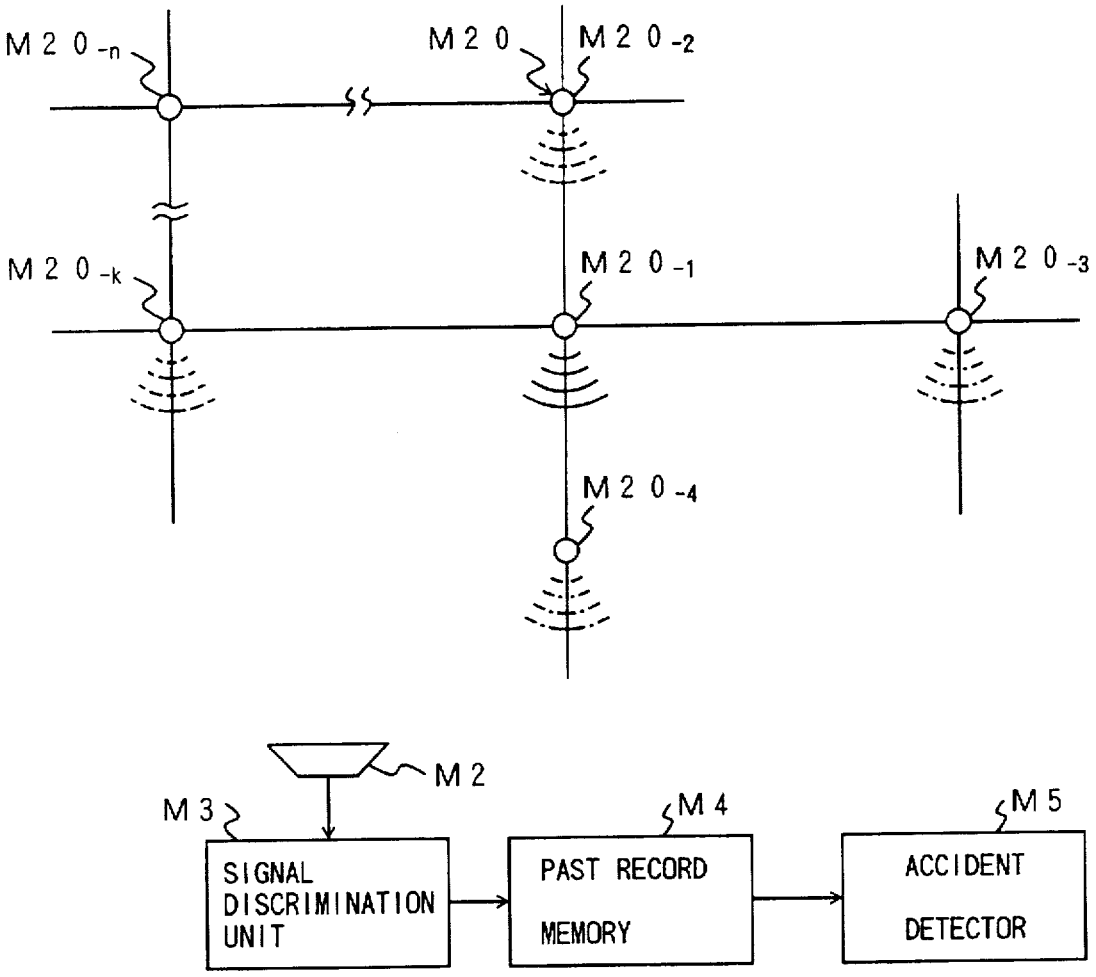
FIG. 7 is a block diagram of a seventh principle of the communications infrastructure system for a vehicle according to the present invention.

FIG. 7 is a block diagram of a seventh principle of the present invention in which further features are added to the first principle shown in FIG. 1. In FIG. 6, those parts that are the same as the ones shown in FIG. 1 are given the same reference numbers, and a description thereof will be omitted.

The communications infrastructure system according to the seventh principle of the present invention includes an infrastructure for a two-dimensional road system having intersections. The infrastructure includes a plurality of beacons M20 positioned at the intersections. The beacons are placed so that every beacon among a set of adjacent beacons transmits a different kind of signal. For example, in FIG. 7, the beacon M20-$_1$ and the beacons M20-$_2$ to M20-k each transmit a different kind of signal, respectively. According to the communications infrastructure system, the past record recorded in the past record unit M4 always corresponds to a driving route of a vehicle not only when the vehicle goes straight at an intersection but also when the vehicle turns at the intersection. Thus, according to the communications infrastructure system, the moving direction of the vehicle can be easily detected from the past record in every situation.

Now, a description will be given, with reference to FIG. 8 through FIG. 18, of a first embodiment of the present invention.

Figure 8:
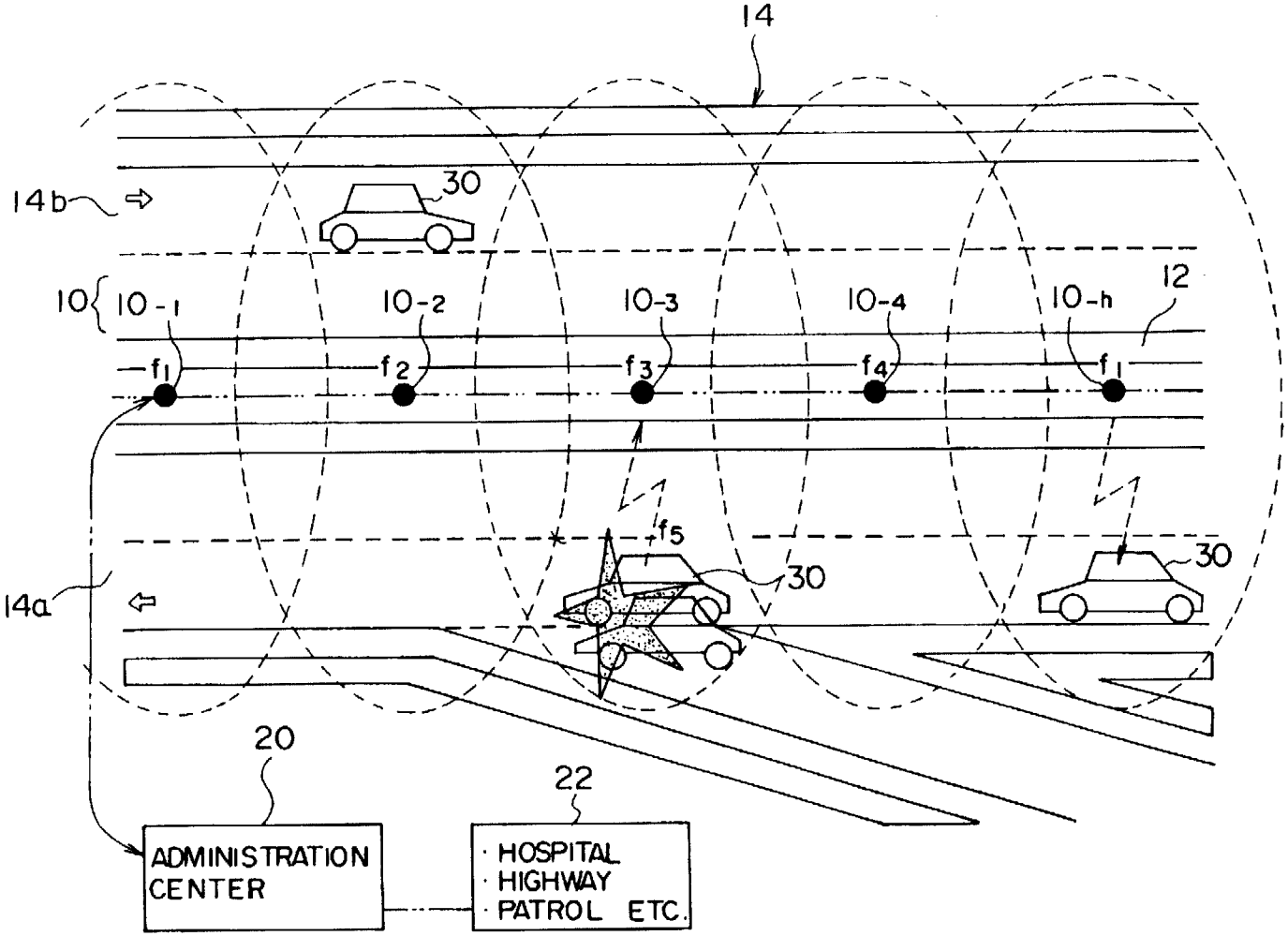
FIG. 8 is a schematic illustration of a communications infrastructure system for vehicles according to a first embodiment of the present invention.

FIG. 8 is a schematic illustration of a communications infrastructure system for vehicles according to the first embodiment of the present invention. The communications infrastructure system allows communications between beacons 10 (including beacons 10-$_1$ to 10-n) placed along a median strip 12 of a highway 14 and vehicles 30 moving along the highway 14. Each beacon 10 is a wireless station having a transmitter and a receiver. The beacons 10 are positioned so that the distance between each two adjacent beacons is substantially equal and communication areas of two adjacent beacons overlap each other.

The transmitter placed at each beacon 10-n transmits a signal having a predetermined frequency. In this embodiment, one of the frequencies $f_1$, $f_2$, $f_3$ or $f_4$ is assigned to each beacon 10-n as a transmitting frequency. Particularly, in this embodiment, the transmitting frequencies are given to the beacons 10 so that the frequency of the signal transmitted from the beacons 10 is changed repeatedly from $f_1$ to $f_4$, in turn, along the highway 14 from the left side to the right side of FIG. 8. Thus, the frequency of the signal received by the vehicle 30 moving along the highway 14 from the left side to the right side in FIG. 8 sequentially changes in the order $f_1$, $f_2$, $f_3$ and $f_4$. On the other hand, the frequency of the signal received by the vehicle moving along the highway 14 from the right side to the left side in FIG. 8 sequentially changes in the order $f_4$, $f_3$, $f_2$ and $f_1$. Hereinafter, the lane direction from the right side to the left side in FIG. 8 will be called an up lane 14*a* and the lane direction from the left side to the right side in FIG. 8 will be called a down lane 14*b*.

The beacons 10 communicate with an administration center 20. The administration center 20 supplies traffic information to the vehicles 30 moving along the highway 14 via the beacons 10 and collects information of the vehicles 30 transmitted from the vehicles 30 by using the beacons 10. Moreover, the administration center 20 can supply traffic information via designated beacons and can detect the beacon 10-n which sends on information about vehicles 30 to the administration center 20. The administration center 20 is connected to some organizations 22, such as hospitals, the highway patrol, etc., by a communications network. Thus, the organizations 22 can receive information about the vehicles 30 from the administration center 20 and the administration center 20 can receive several kinds of information from the organizations 22.

The receiver in each beacon 10-n receives a signal having a frequency $f_5$. On the other hand, the vehicles 30 have a communication apparatus 40 (shown in FIG. 9) which receives a signal having frequencies $f_1$, $f_2$, $f_3$, $f_4$ or $f_5$, accepts some of the signals as traffic information and transmits a signal having the frequency $f_5$ in predetermined circumstances. The signal having the frequency $f_5$ is transmitted from a vehicle 30 when the vehicle 30 is involved in an accident as shown in FIG. 8 in the up lane 14*a* and received by beacons positioned near the vehicle 30.

Figure 9:
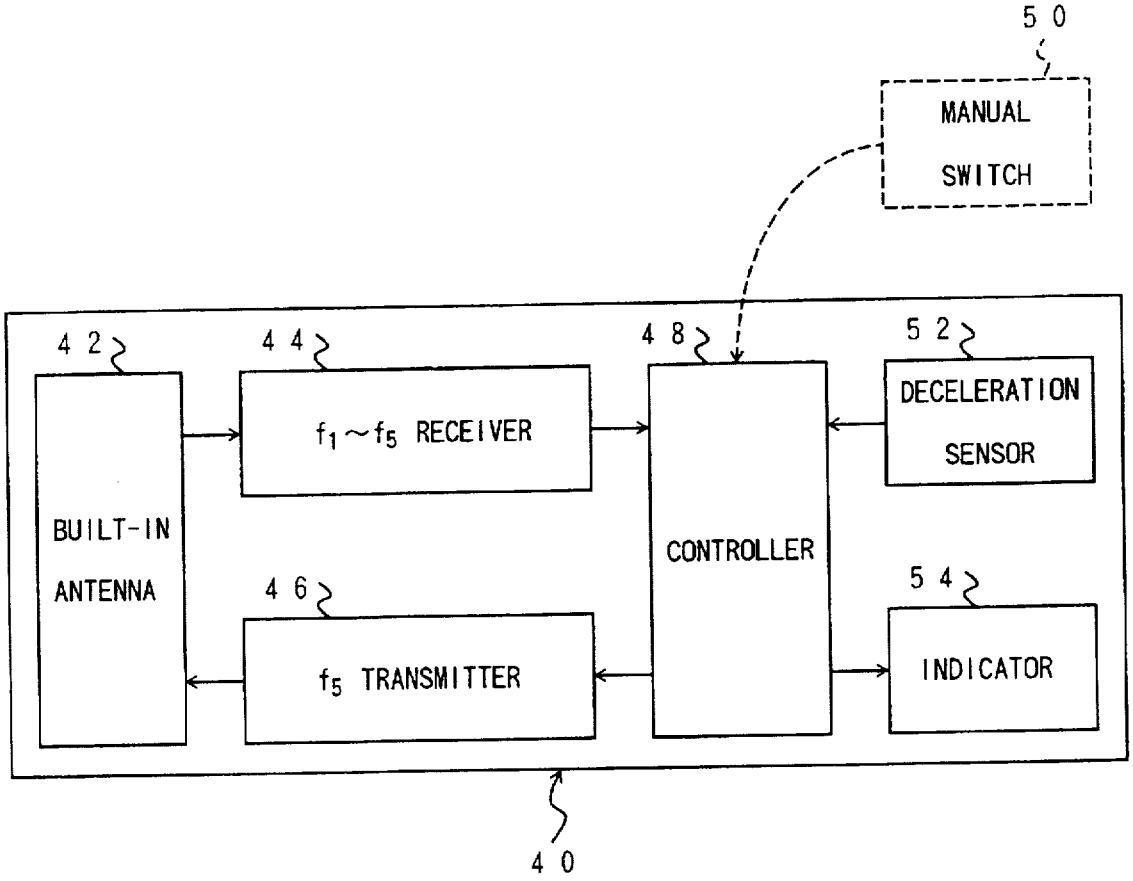
FIG. 9 is a block diagram of a communications apparatus according to the first embodiment of the present invention.

FIG. 9 is a block diagram of a communications apparatus 40. The communications apparatus 40 includes a built-in antenna 42, a receiver 44, a transmitter 46, a controller 48, a manual switch 50, a deceleration sensor 52 and an indicator 54 including a speaker. The built-in antenna 42 is connected to the receiver 44 and the transmitter 46. The receiver 44 receives signals having one of the frequencies $f_1$, $f_2$, $f_3$, $f_4$ or $f_5$ from the antenna 42. Thus, the communications apparatus 40 receives not only the signal transmitted from the beacons but also the signal transmitted from other vehicles 30. The transmitter 46 transmits a signal having the frequency $f_5$ with a predetermined power. The power of the transmitter 46 is substantially the same as the power of the transmitter of the beacons 10. The receiver 44 and the transmitter 46 are also connected to the controller 48.

In addition to the receiver 44 and the transmitter 46, the manual switch 50, the deceleration sensor 52 and the indicator 54 are connected to the controller 48. The deceleration sensor 52 detects deceleration exerted on the vehicle 30. The controller 48 recognizes an accident involving the vehicle 30 has occurred when deceleration exceeding a predetermined level is detected by the deceleration sensor 52. The indicator 54 is placed in the passengers section of the vehicle so that the occupants of the vehicle 30 can watch the indicator 54 and can hear the speaker of the indicator 54. The controller 48 informs the occupants of traffic information via the indicator 54. The manual switch 50 is placed to operate the controller 48 manually. Two switches are included in the manual switch 50. When one of the switches is operated, the controller 48 performs the predetermined function which is taken when an accident is detected, regardless of the detection result of the deceleration sensor 52. The other switch of the manual switch 50 is operated to turn on or off the indicator 54.

In the present embodiment, the beacons 10, the administration center 20 and the communications apparatus 40 provided on each vehicle 30 executes the steps of the flowcharts shown in FIG. 10 through FIG. 18.

Hereinafter, a description of the steps will be given.

Figure 10:
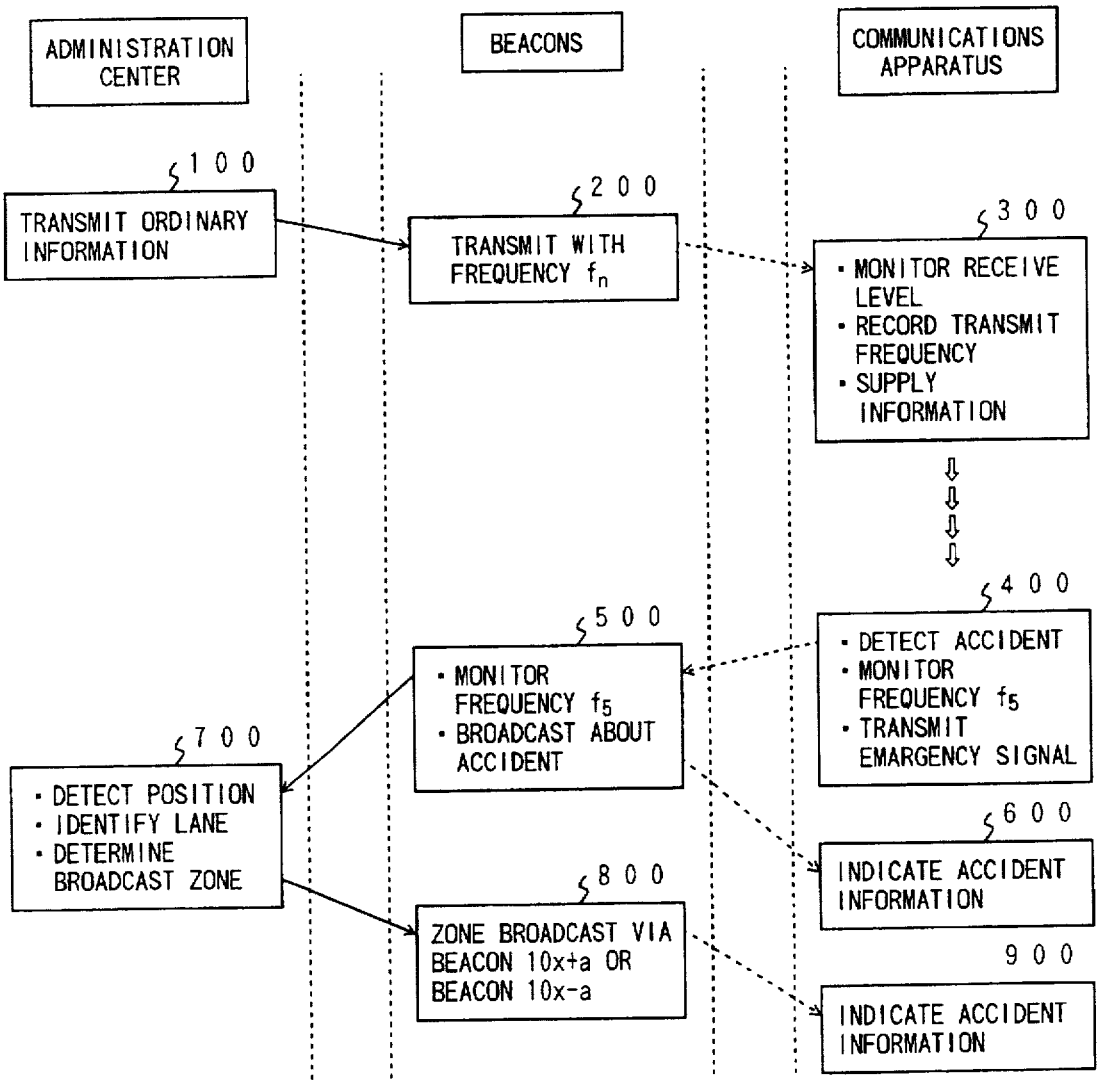
FIG. 10 is a flowchart showing steps executed by a communications apparatus provided with a vehicle, beacons placed along a road and an administration center connected to the beacons in the first embodiment of the present invention.

FIG. 10 is a flowchart showing steps executed by the beacons 10, the administration center 20 and the communications apparatus 40. As shown at step 100 in FIG. 10, the administration center 20 usually transmits ordinary information to each of the beacons 10. As shown in step 200, each of the beacons 10 transmits ordinary information to the vehicles 30 with frequency fn (n equal to one of 1 to 4) which is assigned beforehand to each of the beacons 10.

On the other hand, as shown in step 300, the communications apparatus 40 usually monitors the receiving level of the signal transmitted from the beacons 10 and selects an appropriate channel corresponding to the frequency fn based on the receiving level. Further, the communications apparatus 40 records the transmit frequency fn and supplies information to occupants of the vehicle 30. Moreover, as shown in step 400, the communications apparatus 40 detects an accident involving the vehicle 30 and monitors the level of the signal having the frequency $f_5$, i.e., the signal transmitted from other vehicles 30 as emergency information, and when the occurrence of an accident is detected, transmits emergency information with frequency $f_5$ unless the emergency signal is already transmitted by other vehicles 30

Each of the beacons 10, as shown in step 500, usually monitors the level of the signal having frequency $f_5$. When a level exceeding a predetermined level is detected by one of the beacons 10, the beacon recognized that an accident has occurred near the beacon. Thereafter, the beacon transmits the information about the occurrence of the accident to the administration center 20 and starts broadcasting information of the accident toward vehicles 30 positioned in the communication area of the beacon. Hereinafter the broadcast carried out by the beacon positioned near the accident scene will be called "first broadcast".

When the first broadcast is started, in step 600, information of the first broadcast, i.e., information of the accident, is indicated to the occupants of the vehicles 30 positioned in the communication area of the beacon, whether the indicator 54 is turned on or off. On the other hand, at the administration center 20, as shown in step 700, the position of the accident scene is detected, and the lane in which the vehicle 30 transmitted the signal having frequency $f_5$ is identified as the up lane 14*a* or the down lane 14*b*. Further a zone located on the road behind the accident scene is determined as a broadcast zone where detailed information about the accident is broadcasted.

Thereafter, as shown in step 800, a broadcast is started instead of the first broadcast by one of the beacons 10 positioned in the broadcast zone determined by the administration center 20. Hereinafter, the broadcast carried out by a beacon positioned in a broadcast zone will be called a "zone broadcast". In the zone broadcasting, as discussed above, the broadcast is carried out by the beacons positioned prior to the accident scene. More particularly, in a case where an accident occurs near the beacon 10-x which is placed at the (x)th post of the highway 14, if the accident has occurred in the up lane 14*a*, the zone broadcast is carried out via the beacon 10-x−a which is placed at the (x−a)th post of the highway 14, and if the accident has occurred in the down lane 14*b*, the zone broadcast is carried out via the beacon 10-x+a which is placed at the (x+a)th post of the highway 14.

When signals due to the zone broadcast are received by the communications apparatus 40, in step 900, the information about the accident is indicated to the occupants whether the indicator 54 is turned on or off. Thus, the information of the zone broadcast is transmitted to the occupants of the vehicles 30 which are moving in the lane in which an accident has occurred and which are moving toward the accident.

Figure 11:
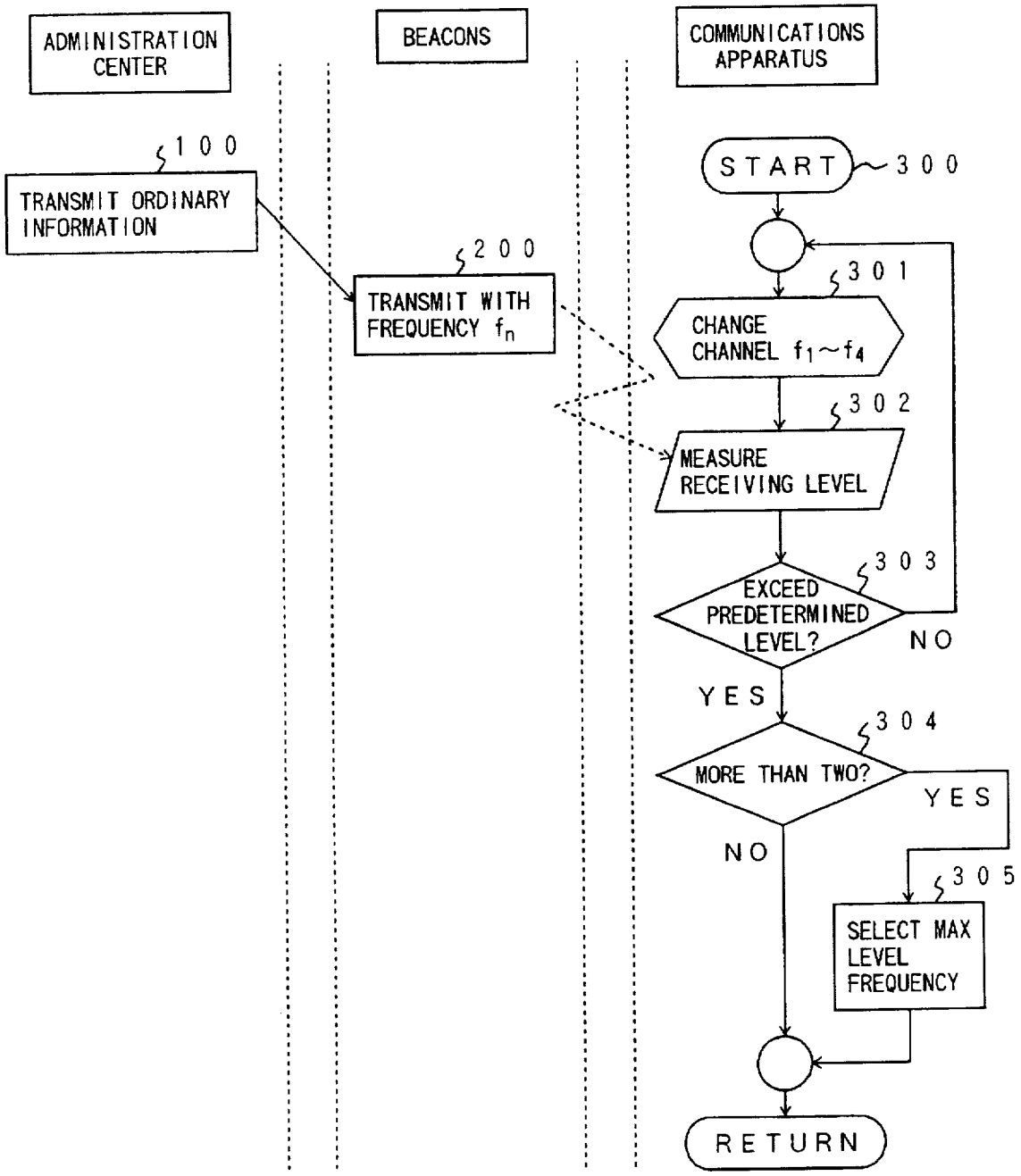
FIG. 11 is a flowchart of a routine executed for determining the frequency of a signal received by a communications apparatus in the first embodiment of the present invention.
Figure 12:
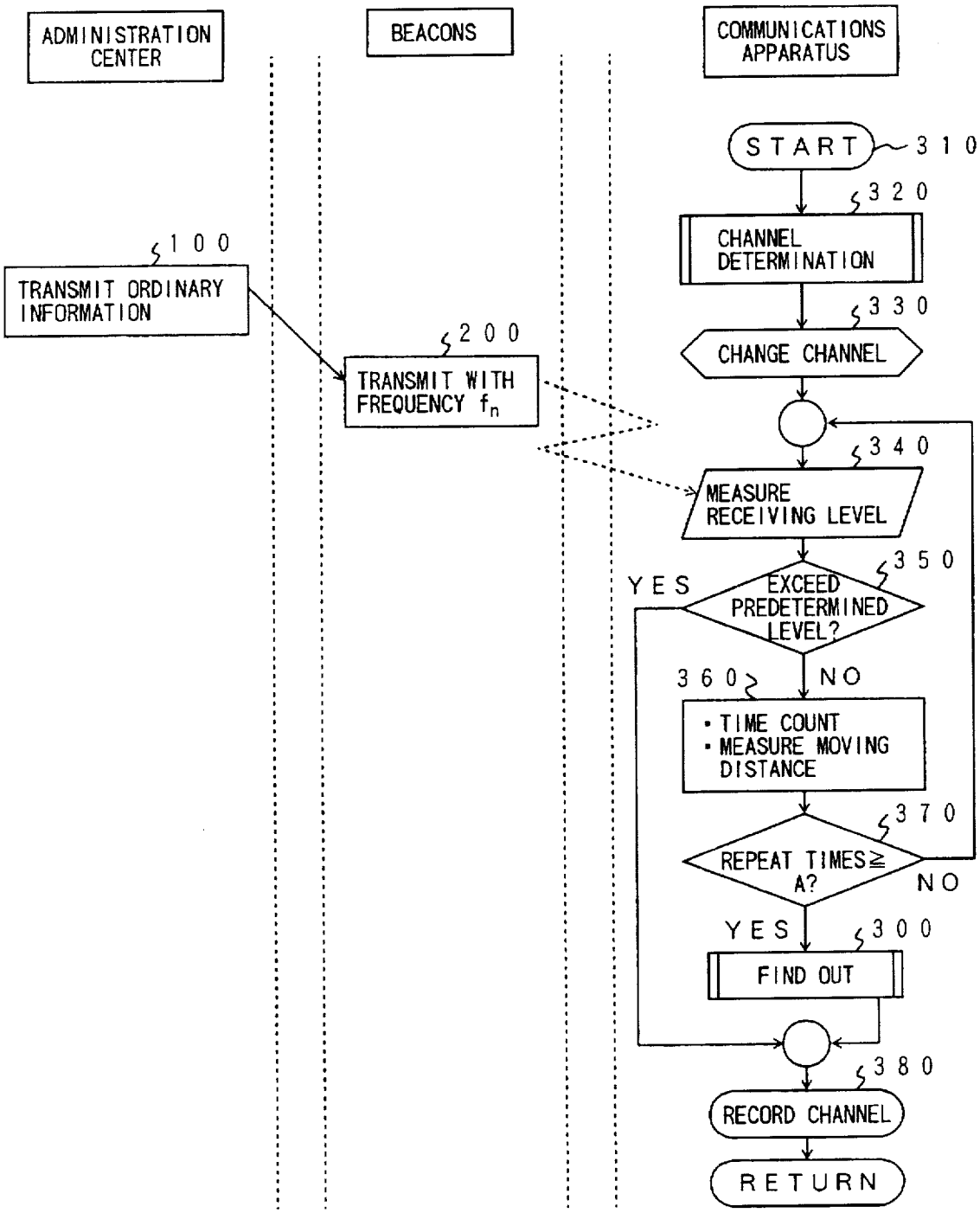
FIG. 12 is a flowchart of a routine executed for changing channels of a communications apparatus in the first embodiment of the present invention.
Figure 13:
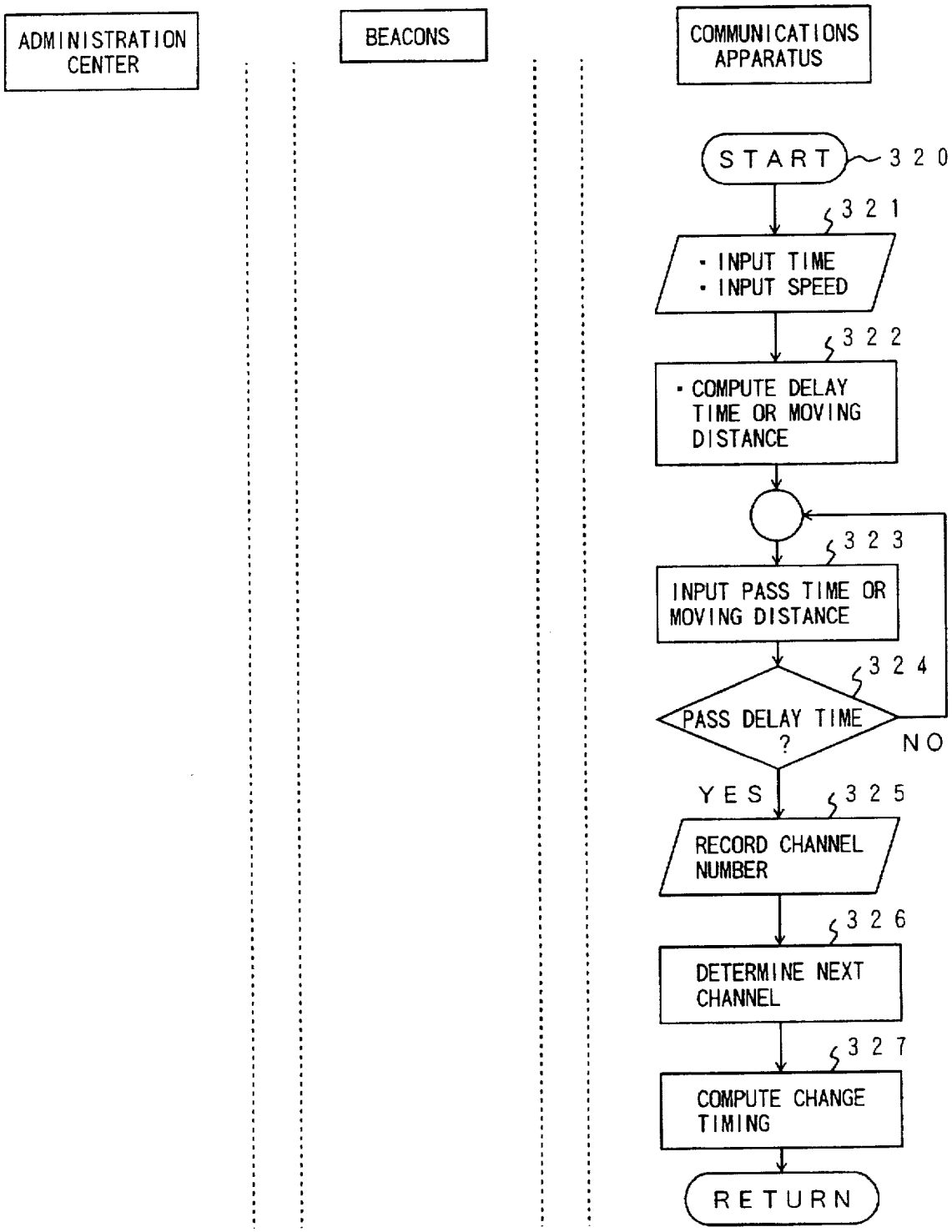
FIG. 13 is a flowchart of a routine executed for determining a next channel of the communications apparatus to be set and a change timing of the channel in the first embodiment of the present invention.

FIG. 11 through FIG. 13 show flowcharts which detail the contents of step 300 shown in FIG. 10. When the communications apparatus 40 starts working, the routine according to the flowchart shown in FIG. 11 is started. This routine is executed for determining a channel which corresponds to the frequency of the signal received by the built-in antenna 42 of the communications apparatus 40.

The receiver 44 has five channels, each of which corresponds to one of the frequencies $f_1$, $f_2$, $f_3$, $f_4$, and $f_5$. When the routine is started, at first in step 301, a channel corresponding to one of the frequencies $f_1$, $f_2$, $f_3$, and $f_4$ is set. In step 302, the level of the signal received by the receiver 44 is measured. In a case where the channel set in step 301 agrees with the frequency of the signal received by the communications apparatus 40, the receiving level of the signal exceeds a predetermined value. On the other hand, in a case where the channel set in step 301 does not agree with the frequency of the signal received by the communications apparatus 40, the receiving level does not exceed the predetermined value.

In step 303, it is determined whether or not the receiving level exceeds the predetermined level. As a result, if it is determined that the receiving level exceeds the predetermined level, the routine proceeds to step 304. On the other hand, if it is determined that the receiving level does not exceed the predetermined level, the routine returns to step 301 and then after the channel of the receiver 44 is changed to an other channel corresponding to one of the frequencies $f_1$, $f_2$, $f_3$, and $f_4$, the execution of step 302 and 303 is then repeated.

In step 304, it is determined whether or not more than two signals which exceed the predetermined level. Step 304 is executed for preventing the routine from being out of control in an extraordinary case where more than two signals having high level are detected.

If it is determined, in step 304, that more than two signals are detected, the routine proceeds to step 305. In step 305, the frequency of the signal which gives a maximum receiving level is selected as the frequency of the channel of the receiver 44. On the other hand, if it is determined that only one signal is detected as the signal which gives a high receiving level, the routine is finished after the frequency of the signal is selected as the frequency for the channel of the receiver 44.

In the present embodiment, the frequency of the signal received by the vehicle 30 moving along the highway 14 changes as the position of the vehicle 30 changes. Thus, it is necessary to change the channel of the receiver 44 as the position of the vehicle 30 changes. The controller 48 executes steps of the flowcharts shown in FIG. 12 and FIG. 13 to change the channel of the receiver 44 so as to always agree with the frequency of the signal received by the vehicle 30, after the execution of the flowchart shown in FIG. 11.

When the routine shown in FIG. 12 is started, in step 320, the next channel which should be selected and a timing as to when the channel should be changed are determined. The determination is executed by the subroutine shown in FIG. 13. In step 330, the channel of the receiver 44 is changed according to the determination result of step 320. After the channel is changed, in the next step 340, a receiving level of a signal which is received by the receiver 44 is measured. In a case where the channel selected in step 330 agrees with the frequency of the signal transmitted by one of the beacons 10 positioned nearest the vehicle 30, the receiving level of the signal exceeds a predetermined level. On the other hand, in a case where the channel selected in step 330 does not agree with the frequency of the signal, the receiving level of the signal does not exceed the predetermined level.

In step 350, it is determined whether or not the receiving level exceeds the predetermined level. As a result, if it is determined that the receiving level exceeds the predetermined level, the routine proceeds to step 380. In step 380, the channel number set in step 330 discussed above is recorded.

On the other hand, if it is determined in step 350 that the receiving level does not exceed the predetermined level, the routine proceeds to step 360. The determination that the receiving level does not exceed the predetermined level is provided not only in a case where an incorrect channel is determined in step 320 but also in a case where the channel is changed at a wrong time, i.e., too soon.

In step 360, the count down of a predetermined time and the measurement of a predetermined moving distance are carried out. When the count down is finished or the predetermined moving distance is measured, the routine proceeds to step 370.

In step 370, it is determined whether or not a number of repeat times of the execution of step 370 reaches a predetermined value A. If it is determined that the number of repeat times has not yet reached A, the routine returns to step 340 and the execution of steps 340 to 370 is then repeated.

If it was determined that the receiving level did not exceed the predetermined level, in step 350, because of the wrong setting of the change timing, the condition of step 350 will be established before the condition of step 370 is established. Therefore, in a case where the channel determined in step 320 is not wrong, the condition of the step 350 will be established after all. In this case, step 380 is executed following step 350 in due time.

On the other hand, in a case where the channel determined in step 320 is incorrect, the number of repeat times of the execution of the step 370 will reach A, and then the step 300, i.e., the routine shown in FIG. 11 will be executed following step 370. In this case, the channel number determined by the routine shown in FIG. 11 is recorded in step 380.

Now, a description of the determination routine shown in FIG. 13 will be given. In the present embodiment, each of the beacons 10 transmits a signal with one of the frequencies $f_1$ to $f_4$. Moreover, the beacons 10 are positioned so that communication areas of two adjacent beacons overlap with each other. Therefore, the change timing is to be set when the vehicle 30 passes through overlapping communication areas of adjacent beacons. Hereinafter, adjacent beacons are described with reference number 10-k and 10-k+1.

The timing of the vehicle 30 passing through overlapping communication areas of two adjacent beacons 10-k and 10-k+1 can be computed based on the distance between the adjacent beacons 10-k and 10-k+1, and the speed of the vehicle 30. Moreover, the distances between adjacent beacons are substantially equal as discussed above. Thus, in the present embodiment, the change timing of the channel of the receiver 44 is computed based only on the speed of the vehicle 30.

Further, the change pattern of the frequency of the signal received by the communications apparatus 40 is limited to the first pattern; the pattern in which the frequency repeatedly changes in the order $f_1$, $f_2$, $f_3$, $f_4$, or the second pattern; the pattern in which the frequency repeatedly changes in the order $f_4$, $f_3$, $f_2$, $f_1$. Therefore, the frequency following the frequency actually detected can be easily determined based on the past record of the frequency.

When the routine shown in FIG. 13 is started, in step 321, the time when the vehicle 30 passes by one of the beacons 10 and the speed of the vehicle 30 at that moment are input. The communication apparatus 40 recognizes that the vehicle 30 passes by one of the beacons 10 when the receiving level of the signal received by the vehicle 30 indicates a peak value.

In step 322, a delay time or a moving distance is computed. In step 323, a time or a travel distance after the vehicle 30 has passed the one of the beacons 10 is input. Then, in step 324, it is determined whether or not the time is equal to the delay time computed in step 322 or if the travel distance is equal to the distance computed in step 322. As a result, if it is determined that the delay time has not expired and the travel distance has not been completed, the routine returns to step 323 and the execution of steps 323 and 324 will be repeated. On the other hand, if it is determined that the delay time has expired or the moving distance has been completed, the routine proceeds to step 325.

In step 325, the channel number of the receiver 44 is recorded. The channel number is to correspond to the frequency of the signal which is received by the vehicle 30. Moreover, the communications apparatus 40 previously recorded the channel numbers which were detected during a past predetermined period. Thus, the changes of the frequency of the signal received by the vehicle 30 during the past predetermined period is recorded by the communications apparatus 40 as a past record of the frequency of the signal.

In step 326, the channel which is selected as a next channel of the receiver 44 is determined based on the past record of the frequency of the signal. More particularly, in a case where the last channel of the receiver 44 corresponds to the frequency $f_1$, if the past record shows that $f_1$, $f_2$, $f_3$, $f_4$ is recorded, the channel corresponding to the frequency $f_2$ is selected as the next channel of the receiver 44. On the other hand, in the same case, if the past record shows that $f_4$, $f_3$, $f_2$, $f_1$ is recorded, the channel corresponding to the frequency $f_4$ is selected as the next channel of the receiver 44.

After the determination of the next channel, in step 327, the change timing of the channel is computed. In the present routine, as discussed above, the timing when the vehicle 30 will reach to an overlapping communication area between two adjacent beacons 10-k and 10-k+1 is computed as the change timing. The change timing computed in step 327 substantially agrees with the timing when the transmitter of the signal received by the vehicle 30 is changed from a beacon 10-k to a beacon 10-k+1 (or a beacon 10-k−1). Thus, according to the routines shown in FIG. 12 and FIG. 13, the channel of the receiver 44 appropriately corresponds to the frequency of the signal which is received by the vehicle 30.

Figure 14:
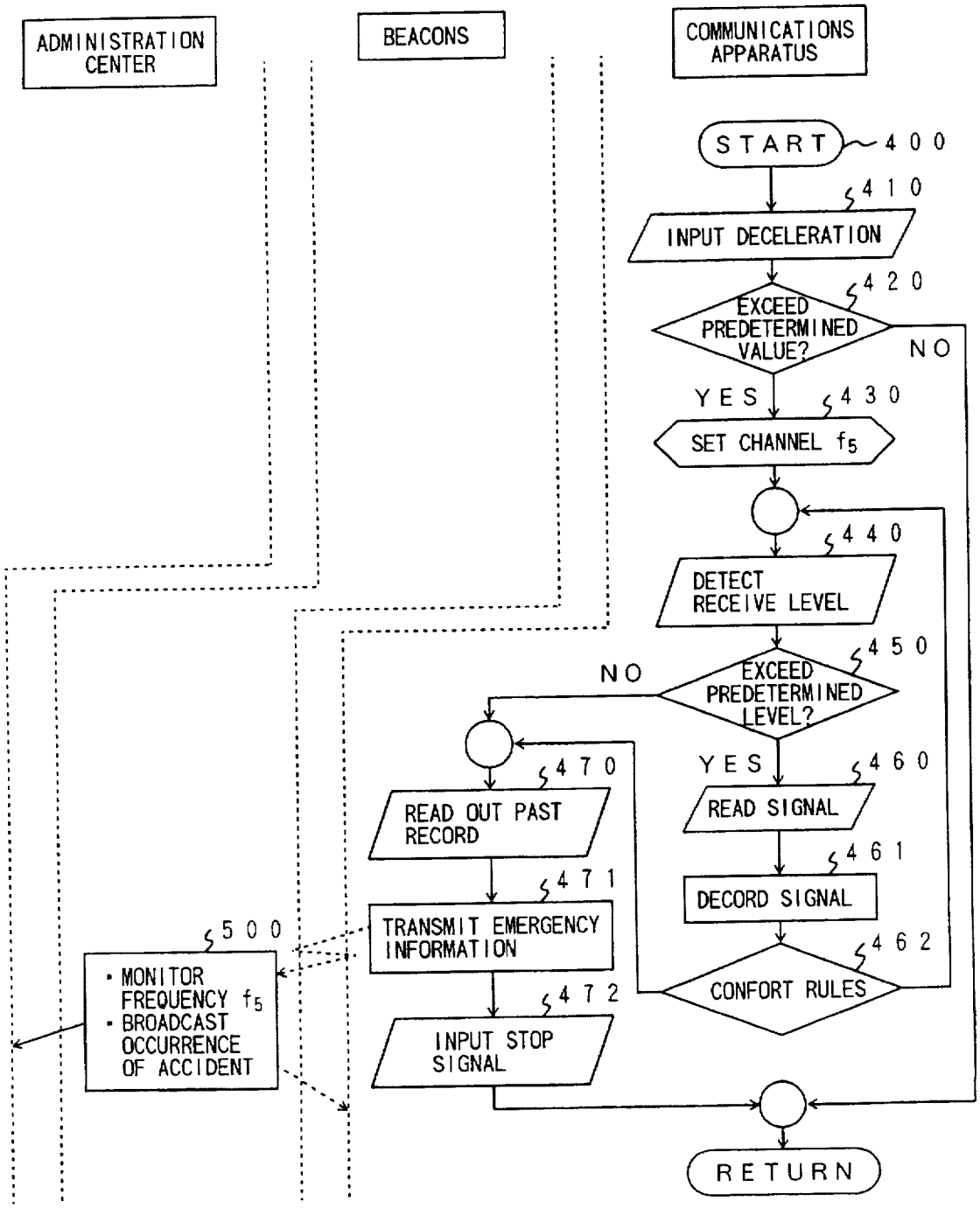
FIG. 14 is a flowchart of a routine executed for detecting a vehicle accident and transmitting emergency information from a communications apparatus to beacons in the first embodiment of the present invention.

Besides the routines shown in FIG. 12 and FIG. 13, the communications apparatus 40 executes a routine shown in FIG. 14 for detecting an accident and informing the beacons 10 of the occurrence of the accident.

When the routine shown in FIG. 14 is started, in step 410, deceleration of the vehicle 30 is read from the deceleration sensor 52. In step 420, it is determined whether or not the deceleration exceeds a predetermined value. If it is determined that the deceleration exceeds a predetermined value, it will be considered that an extraordinary shock is exerted on the vehicle 30, namely, that an accident involving the vehicle 30 has occurred. In this case, the routine proceeds to step 430 to transmit emergency information about the accident to the beacons 10. On the other hand, if it is determined that the deceleration does not exceed a predetermined value, it will be considered that an accident involving the vehicle 30 has not occurred. Thus, in this case, the routine will be finished without executing any other procedures.

In step 430, the channel of the receiver 44 is set to the channel corresponding to the frequency $f_5$, to determined whether or not the transmission about the accident is carried out by other vehicles 30. After the setting, in next step 440, the receiving level of the signal having frequency $f_5$ is detected. In following step 450, it is determined whether or not the receiving level of the signal exceeds a predetermined value. As a result, if it is determined that the receiving level exceeds the predetermined value, it will be considered that the transmission about the accident is being carried out by other vehicles 30. In this case, the routine proceeds to step 460. On the other hand, if it is determined that the receiving level does not exceed the predetermined value, it will be considered that the transmission about the accident is not carried out by other vehicles 30. In this case, the routine proceeds to step 470.

In step 460, the signal having frequency $f_5$ is read by the receiver 44. Then, in step 461, the signal is decoded. Thereafter, in step 462, it is determined whether or not the decoded data of the signal conforms to predetermined rules. As a result, if it is determined that the decoded data conforms to the rules, it can be considered that the transmission about the accident is already being carried out by other vehicles 30. In this case, the routine returns to step 440 and then the execution of step 440 to 460 will be repeated. On the other hand, if it is determined that the decoded data does not conform to the rules, it can be considered that the signal received by the receiver 44 is not the signal transmitted as the emergency information about the accident. In this case, the routine proceeds to step 470.

The steps following step 470 are executed to supply emergency information to the beacons 10. In step 470, the past record of the frequency is read out.

In step 471, the emergency information including the past record of the frequency is transmitted by the transmitter 46 with the frequency $f_5$. The transmission of the emergency information proceeds until a stop signal is input by the manual switch 50. The routine is finished when the stop signal is input in step 472. According to the routine, the emergency information is transmitted automatically when a shock exceeding the predetermined value is exerted on the vehicle 30 provided with the communications apparatus 40 unless the emergency information is already transmitted by other vehicles 30.

Figure 15:
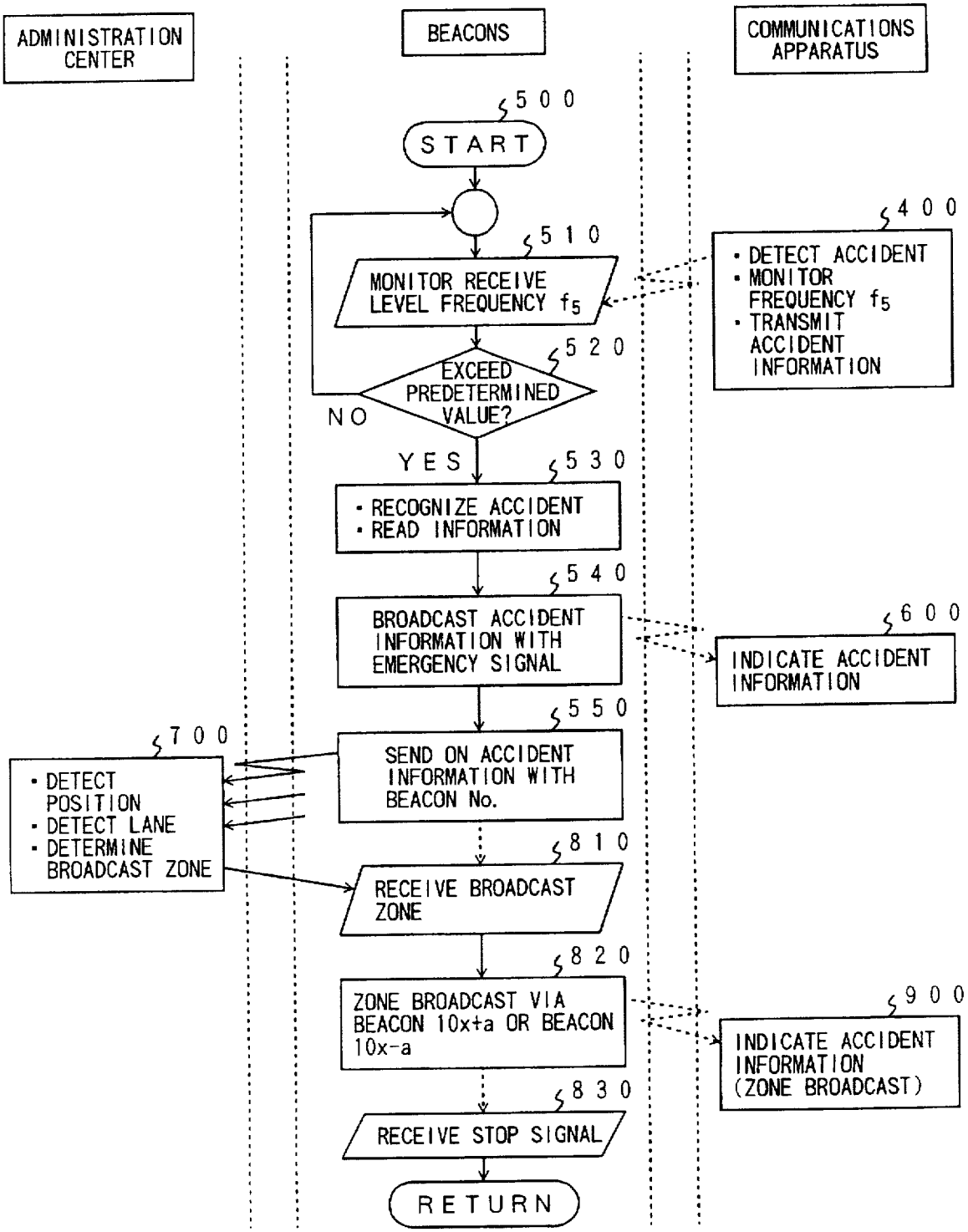
FIG. 15 is a flowchart of a routine executed for transmitting emergency information from a beacon to an administration center in the first embodiment of the present invention.

At each of the beacons 10, a routine for detecting an occurrence of an accident involving the vehicles 30 and informing the administration center 20 of the occurrence of the accident is executed. FIG. 15 is a flowchart of the routine executed by each of the beacons 10. When the routine shown in FIG. 15 is started, at first, in step 510, the receiving level of a signal having frequency $f_5$ is monitored.

Then, in next step 520, it is determined whether or not the receiving level exceeds a predetermined value. If the receiving level does not exceed the predetermined value, it is considered that accident information is not being transmitted from a vehicle positioned near the beacon. In this case, the routine returns to step 510 and then the executions of step 510 and 520 will be repeated until a positive condition of step 520 is established. On the other hand, if it is determined, in step 520, that the receiving level exceeds the predetermined value, it is considered that accident information is being transmitted from a vehicle positioned near the beacon. In this case, the routine proceeds to step 530.

In step 530, the beacon recognizes that an accident has occurred near the beacon and starts reading the accident information transmitted from a vehicle 30. After the reading of the accident information, in step 540, the first broadcast is started. Namely, in step 540, the beacon starts broadcasting about the accident information with an emergency signal with the frequency assigned to the beacon. Thereafter, at the communications apparatuses 40 provided on vehicles 30 which are positioned in the communication area of the beacon, the process of step 600, described in the following in detail, is started.

In step 550, the accident information received by the beacon 10 is relayed to the administration center 20 with the beacon number. For example, in a case where the accident information is received by the beacon 10-n, the number "n" is relayed to the administration center 20 from the beacon 10-n.

Thereafter, at the administration center 20, the process of step 700 is started. As a result, the position of the accident scene and the lane in which the accident has occurred is detected at the administration center 20 and the zone where the detailed accident information is broadcasted, i.e., the zone of the zone broadcast, is determined based on the position and the lane. The process of step 700 will be described in detail in the following.

The zone determined in step 700 by the administration center 20 is informed to each of the beacons 10. In the present embodiment, the zone of the zone broadcast is set at the following side of the accident scene. More particularly, in a case where the accident scene is near the beacon 10-x, if the accident has occurred in the up lane 14*a*, the zone broadcast is carried out via the beacon 10-x−a, and if the accident has occurred in the down lane 14*b*, the zone broadcast is carried out via the beacon 10-x+a.

Thus, when one of the beacons 10 receives information about the zone in step 810, the beacon confirms whether or not the zone and the position of the beacon agree each other. As a result, if the zone and the position agree each other, in step 820, the beacon starts the zone broadcast. On the other hand, if the zone and the position do not agree each other, the beacon does not start the zone broadcast. Accordingly, in a case where an accident has occurred near the (x)th post in the up lane 14*a*, the beacon 10-x−a positioned at the (x−a)th post of the highway 14 starts the zone broadcast. On the other hand, in a case where an accident has occurred near the (x)th post in the down lane 14*b*, the beacon 10-x+a positioned at the (x+a)th post of the highway 14 starts the zone broadcast.

In the zone broadcasting, an emergency signal is transmitted along with the detailed information about the accident. If the emergency signal is received by the communications apparatus 40, the communications apparatus 40 starts the process of step 900 described in detail in the following. The zone broadcasting executed by one of the beacons 10 is proceeded until a stop signal is supplied in step 830. The stop signal is supplied when the acts for clearing up the accident scene, such as removal of the accident vehicles, rescue of the occupants, and so on, are finished. If the beacon receives the stop signal, the zone broadcasting is finished and then the routine is finished.

Figure 16:
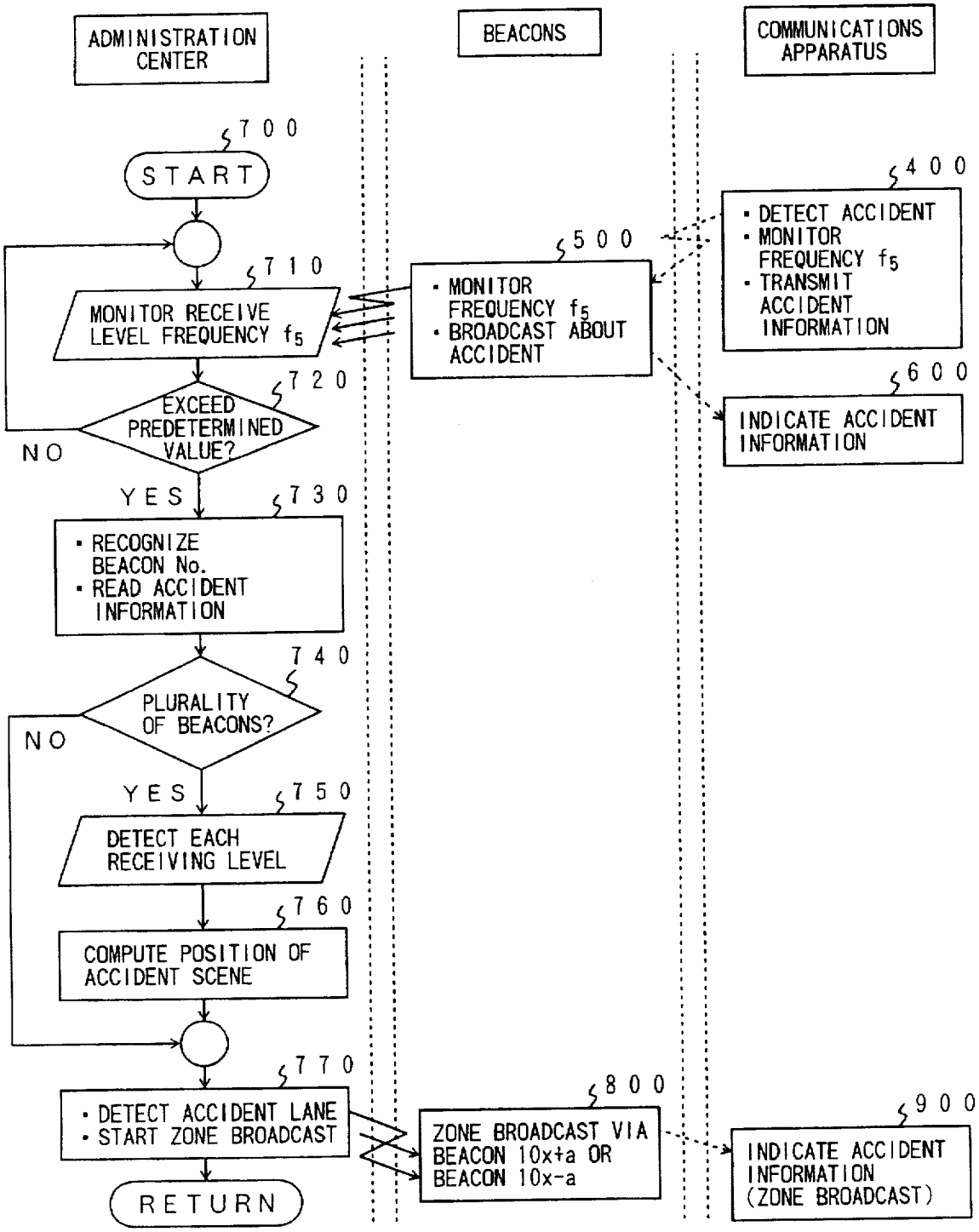
FIG. 16 is a flowchart of a routine executed for detecting the position of a traffic accident and broadcasting the accident toward vehicles located near the position of the traffic accident in the first embodiment of the present invention.

FIG. 16 shows a flowchart of a routine executed by the administration center 20 as a process of step 700 discussed above. When the routine shown in FIG. 16 is started, at first, in step 710, the receiving level of a signal having the frequency $f_5$ is monitored.

Then, in next step 720, it is determined whether or not the receiving level exceeds a predetermined value. If the receiving level does not exceed the predetermined value, the routine returns to step 710 and the executions of step 710 and 720 will be repeated until a positive condition of step 720 is established. On the other hand, in step 720, if it is determined that the receiving level exceeds the predetermined value, the routine proceeds to step 730.

In step 730, the administration center 20 recognizes the numbers of the beacon or beacons which are relaying the accident information and reads the accident information including the information about the position and the past record of frequency of the vehicle 30 which is transmitting the accident information.

As discussed above, the communication area of each of the beacons 10 is set so that two adjacent areas overlap. Thus, if the vehicle 30 is transmitting the accident information from an overlapping communication area between two adjacent beacons, the accident information is sent to the administration center 20 by the two adjacent beacons. In this situation, step 740 to 760 are executed to compute the position of the accident scene.

In step 740, it is determined whether or not the accident information is being relayed by a plurality of beacons. As a result, if the accident information is not being relayed by a plurality of beacons, the routine proceeds to step 770. In this case, it is considered that the accident information is transmitted from near one of the beacons 10 and the position of the accident scene is substantially the same as the position of the beacon.

On the other hand, if it is determined that the accident information is being relayed by a plurality of beacons, the routine proceeds to step 750. In step 750, each level of signals sent to the administration center 20 is detected. A level of the signal received by the administration 20 corresponds to the distance between the vehicle 30 transmitting the signal and the beacon relaying the signal to the administration center 20. Thus, in a case where accident information is relayed to the administration center 20 by a plurality of beacons, the distance between the vehicle 30 transmitting a signal and respective beacons relaying the signal can be detected based on each level of the signal relayed to the administration center 20.

Therefore, in the present routine, after the execution of step 750, in step 760, the position of the vehicle 30 is computed based on each level of signal detected in step 750 and each position of the beacons relaying the signal to the administration center 20. According to the present routine, the position of the vehicle 30 transmitting the accident information, namely, the position of the accident scene, can be accurately detected, whether the accident information is relayed by a single beacon or a plurality of beacons.

After the execution of step 740 or step 760, step 770 is executed. In step 770, at first, the lane in which the accident has occurred is identified as the up lane 14*a* or the down lane 14*b* based on the past record of the frequency included in the information supplied by the vehicle 30. Then, the zone broadcast is started. In the zone broadcast, the information including the position of the accident scene, the lane in which the accident has occurred, and the number of the beacon which is to transmit the detailed accident information is supplied to each of the beacons 10.

Figure 17:
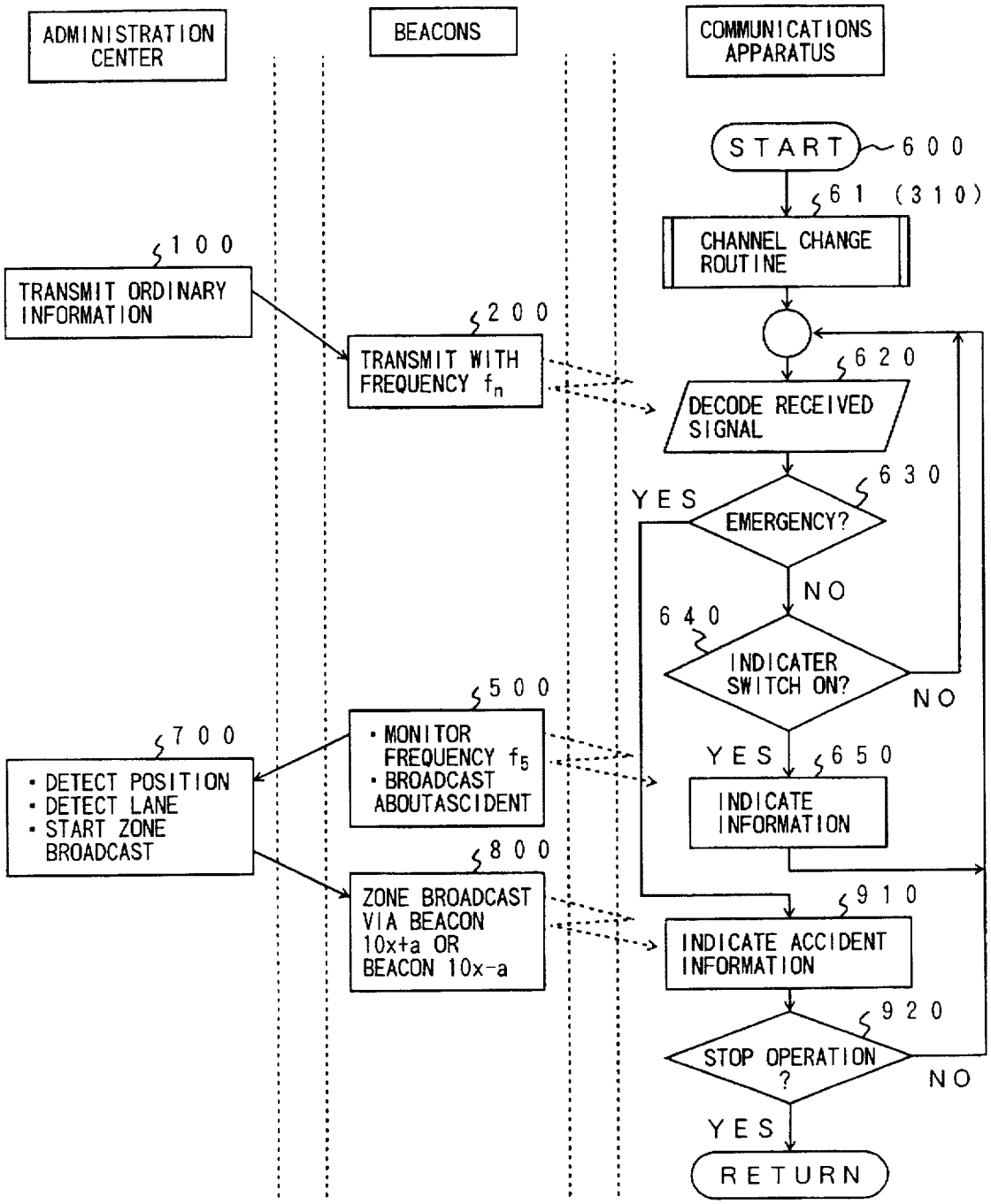
FIG. 17 is a flowchart of a routine executed for changing the receiving mode of a communications apparatus when accident information is broadcasted by beacons in the first embodiment of the present invention.

FIG. 17 shows a flowchart of a mode change routine executed for changing a receiving mode of the communications apparatus 40. The routine is executed whether the manual switch 50 is turned on to make the indicator 54 operative or turned off to make the indicator 54 inoperative.

As discussed above, the communications apparatus 40 executes the channel change routine shown in FIG. 12 for changing the channel of the receiver 44 so that the channel always corresponds to the frequency of the signal received by the communications apparatus 40. The channel change routine is executed as a part of the mode change routine shown in FIG. 12. Namely, when the mode change routine is started, at first, in step 610, the change channel routine is executed. Accordingly, whether the indicator th operates or not, the signals transmitted from the beacons 10 are received by the receiver 44.

In step 620, the signal transmitted to the receiver 44 is received and decoded. After the execution of step 620, in step 630, it is determined whether or not the emergency signal is included in the signal. If the emergency signal is included, it is considered that accident information is being broadcasted by the beacons 10. In this situation, the routine proceeds to step 910. On the other hand, if the emergency signal is not included, it is considered that accident information is not being broadcasted by the beacons 10. In this situation, the routine proceeds to step 640.

In step 640, it is determined whether or not the indicator 54 is turned on or turned off by the manual switch 50. As a result, if it is determined that the indicator 54 is turned on, the routine proceeds to step 650 where the signal received by the receiver 44 is indicated to the occupants of the vehicle 30 as traffic information. After finishing the execution of step 650, the routine returns to step 620 and then the execution of the steps following step 620 will be repeated. On the other hand, if it is determined, in step 640, that the indicator 54 is turned off, the routine returns to step 620 and then the execution of steps 620 to 640 will be repeated. Accordingly, in the situation that the emergency signal is not included in the signal received by the vehicle 30, the signal is indicated as information only when the indicator 54 is turned on by the occupants.

In step 910, information which is included in the signal received by the receiver 44 is indicated to the occupants of the vehicle 30 via the indicator 54. In the present step 910, the information is indicated on the indicator as accident information, whether the indicator 54 is turned on or turned off.

After the execution of step 910, in step 920, it is determined whether or not an operation to stop the indication of the accident information has been carried out. As a result, if it is determined that the operation has not been carried out, the routine returns to step 620 and then the execution of the steps following step 620 will be repeated. On the other hand, if it is determined that the operation to stop the indication has not carried out, the routine is finished to finish the indication.

According to the routine, the accident information is indicated via the indicator 54 of the communications apparatus 40 not only in a case where the indicator 54 is turned on but also in a case where the indicator 54 is turned off. Therefore, according to the communications infrastructure system of the present embodiment, the accident information is transmitted to the occupants of the vehicle 30 moving toward the accident scene.

Incidentally, the beacons 10 transmit signals to both the up lane 14*a* and the down lane 14*b*. Thus, the accident information broadcasted by the beacons 10 is received by vehicles 30 moving not only in the lane in which the accident has occurred but also in the lane in which the accident has not occurred. Namely, in a case where an accident has occurred in the up lane 14*a* near the (x)th post and the accident information is broadcasted via the beacon 10-x–a positioned on the highway behind the accident scene, while the information is useful to the vehicle 30 moving in the up lane 14*a*, the information is not useful to the vehicle 30 moving in the down lane 14*b*. Thus, as to the vehicle 30 moving in the lane in which the accident has not occurred, it is preferable that the accident information is not indicated on the indicator 54.

Figure 18:
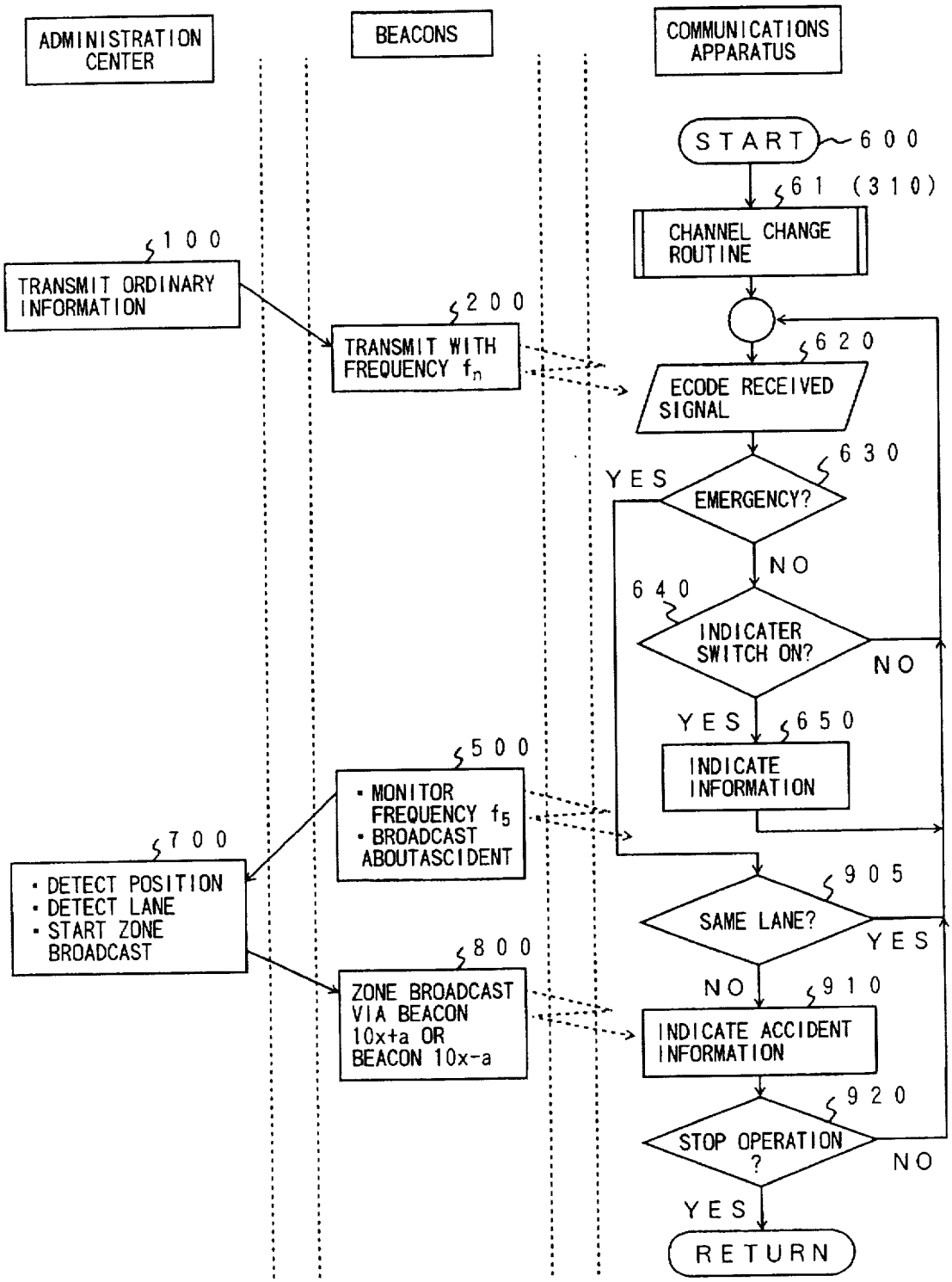
FIG. 18 is an another flowchart of a routine executed for changing the receiving mode of a communications apparatus when accident information is broadcasted by beacons in the first embodiment of the present invention.

The problem discussed above can be removed by having the communications apparatus 40 execute the routine according to the flowchart shown in FIG. 18 instead of the routine shown in FIG. 17. In FIG. 18, those steps that are the same as the ones shown in FIG. 17 are given the same reference numbers, and a description thereof will be omitted.

In the present routine, in a case where it is determined, in step 630, that the emergency signal is included in the signal received by the receiver 44, the routine proceeds to step 905. In step 905, it is determined whether or not the lane in which the vehicle is moving at the present is the same as the lane in which the accident has occurred. As discussed above, the accident information broadcasted by the beacons 10 in a manner of the zone broadcast includes the information about the lane of the accident scene. Moreover, each vehicle 30 has a past record of the frequency which corresponds to the moving direction of the vehicle 30. Thus, the communications apparatus 40 can carry out the determination of step 905 based on the information about the lane of the accident and the past record of the frequency.

As a result, if it is determined that the lane in which the vehicle 30 is moving is not the same as the accident lane, the routine returns to step 620 because it can be considered that the accident information is not useful to the vehicle 30. On the other hand if it is determined that the lane in which the vehicle 30 is moving is the same as the accident lane, the routine proceeds to step 910 because it can be considered that the accident information is useful to the vehicle 30.

According to the routine, the accident information broadcasted by the zone broadcasting is indicated to the occupants of the vehicle 30 only when the vehicle 30 is moving in the lane in which the accident has occurred and moving toward the accident scene. Therefore, according to the present embodiment, it is possible to prevent the occupants from being provided unnecessary information.

As discussed above, in the communications infrastructure system of the present embodiment, four kinds of signals are transmitted by the beacons 10. However, the number of the kinds of the signals is not limited to four. Namely, the communications infrastructure system can be constructed by using at least three kinds of signals.

Moreover, in the communication system discussed above, the kinds of signals are made by changing the frequency of each signal. However, the manner of making the kinds of signals is not limited to changing the frequency. The kinds of signals can be made, for example, by giving each kind of signal an identity code.

Now, descriptions of embodiments of an infrastructure of the present invention placed in a two-dimensional road system having intersections will be given with reference to FIG. 19 to FIG. 26.

Figure 19:
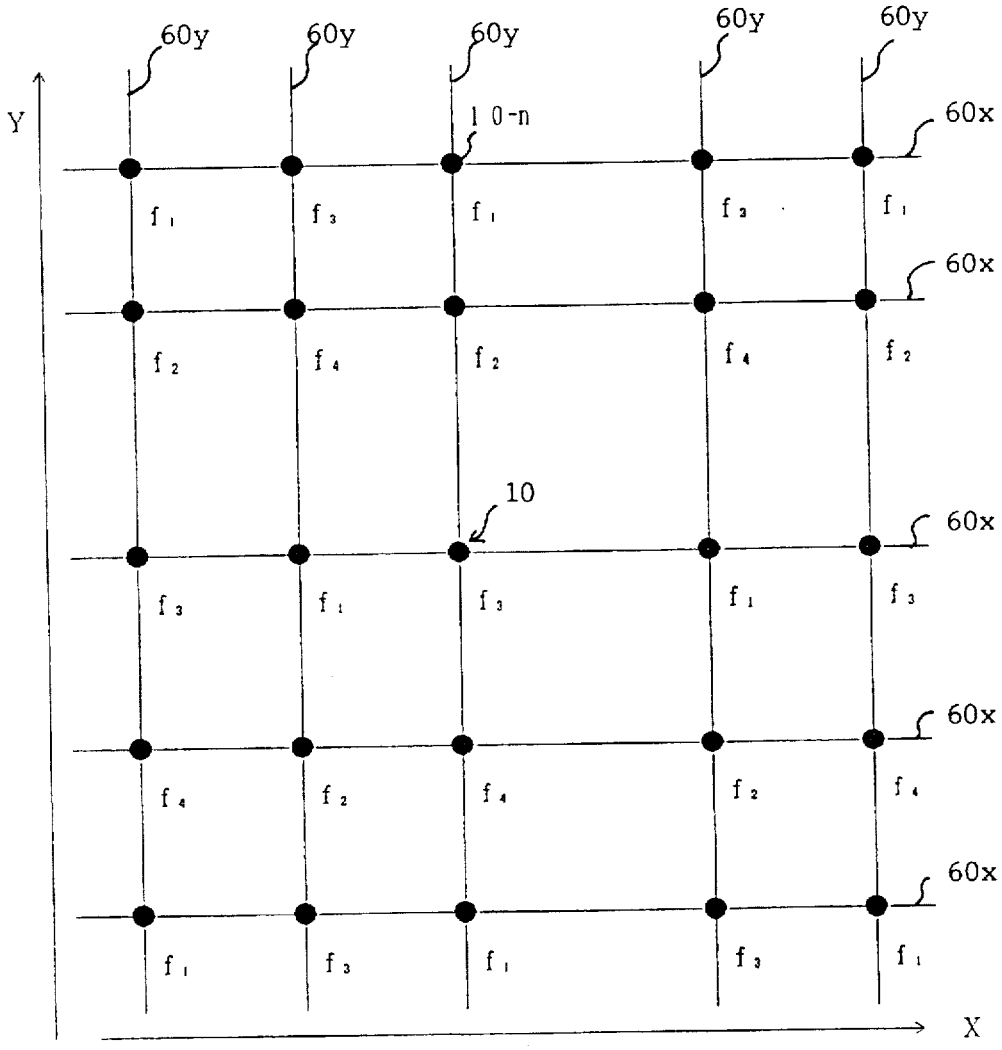
FIG. 19 is a plan view showing beacons arranged as parts of a second embodiment of the infrastructure of the present invention.

FIG. 19 is a plan view showing beacons 10 provided as parts of a second embodiment of the infrastructure of the present invention. In FIG. 19, solid lines 60*x* and 60*y* indicate roads extending along an X direction and a Y direction, respectively.

The infrastructure shown in FIG. 19 has a plurality of beacons 10 each of which is placed at every intersection. Beacons 10 sequentially placed along each road 60*y* in the Y direction transmit respective ones of repeated series of signals having frequency $f_4$, $f_3$, $f_2$, and $f_1$, in that order. In this road system, it is possible to determine the moving direction of a vehicle 30 which is moving along one of the roads 60*y*. Therefore, the communication system including the infrastructure shown in FIG. 19 is useful in a case where each of the roads 60*y* has a median strip and none of the roads 60*x* has a median strip.

Figure 20:
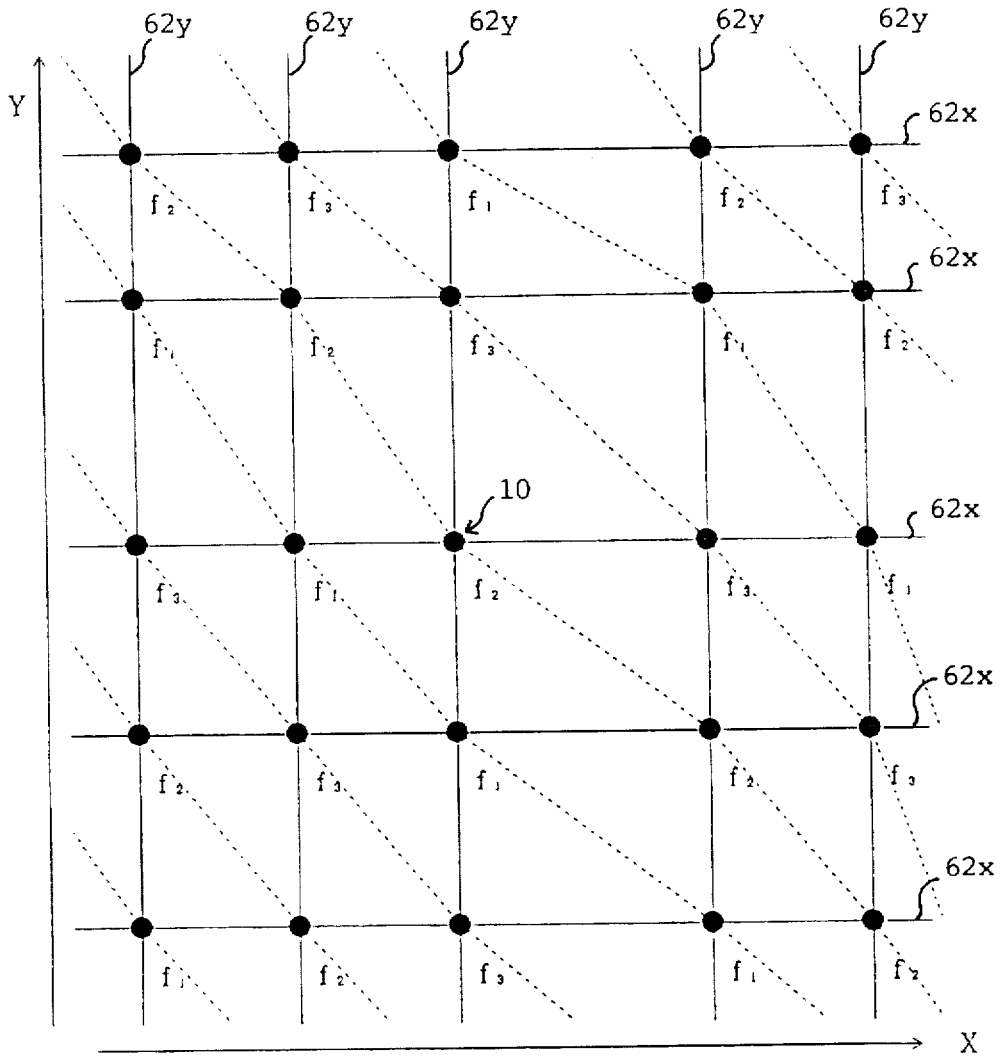
FIG. 20 is a plan view showing beacons arranged as parts of a third embodiment of the infrastructure of the present invention.

FIG. 20 is a plan view showing beacons 10 provided as parts of a third embodiment of the infrastructure of the present invention. In FIG. 20, solid lines 62*x* and 62*y* indicate roads extending along an X direction and a Y direction, respectively, and broken lines connect beacons 10 transmitting the same kind of signal.

The infrastructure shown in FIG. 20 has a plurality of beacons 10 each of which is placed at every intersection. In this road system, beacons 10 sequentially placed along each road 62*y* in the Y direction transmit respective ones of a repeated series of signals having frequencies $f_1$, $f_2$, and $f_3$, in that order. Moreover, in this road system, beacons 10 sequentially placed along each road in the X direction transmit respective ones of a repeated series of signals having the frequencies $f_1$, $f_2$, $f_3$, in that order. According to this road system, it is possible to determine the moving direction of a vehicle 30 not only when the vehicle 30 is moving along one of the roads 62*y* extending along the Y direction, but also when the vehicle 30 is moving along one of the roads 62*x* extending along the X direction. Therefore, the communication system having the infrastructure shown in FIG. 20 is useful in a case where each of the roads extending along either the Y direction or the X direction has a median strip.

Figure 21:
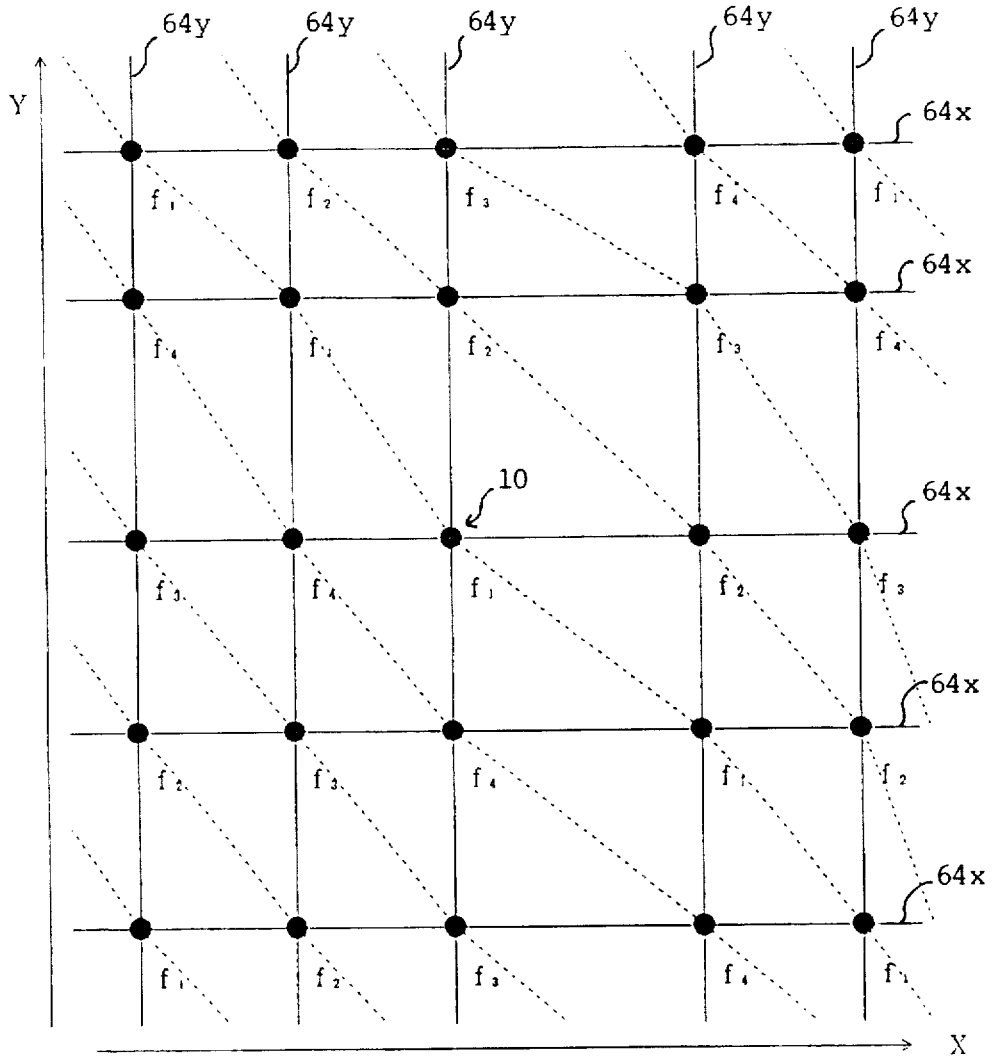
FIG. 21 is a plan view showing beacons arranged as parts of a fourth embodiment of the infrastructure of the present invention.
Figure 22:
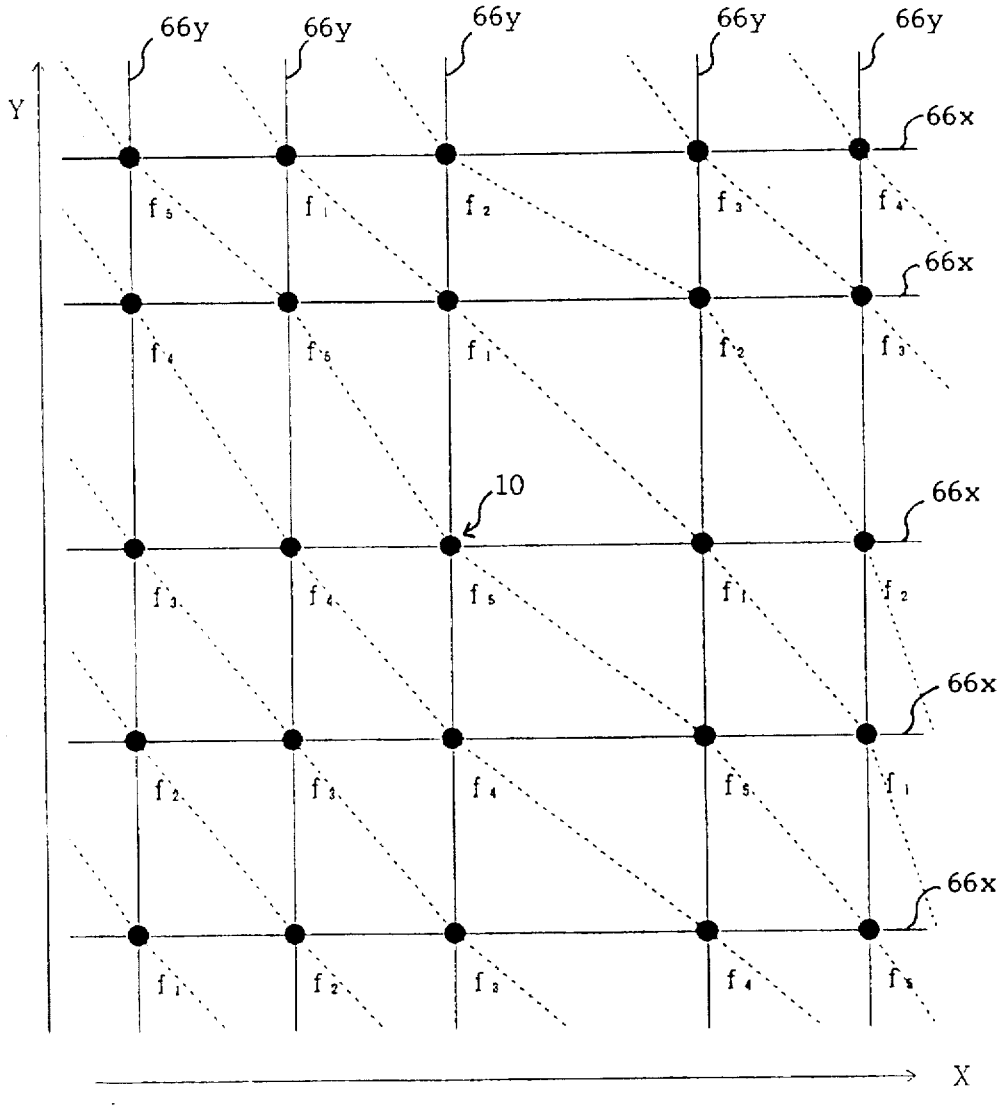
FIG. 22 is a plan view showing beacons arranged as parts of a fifth embodiment of the infrastructure of the present invention.

As discussed above, the beacons 10 shown in FIG. 20 transmit three kinds of frequencies. However, the number of the kinds of the frequencies is not limited to three. FIG. 21 shows a plan view of beacons 10, provided as parts of a fourth embodiment of the infrastructure of the present invention, transmitting four kinds of signals having different frequencies. Moreover, FIG. 22 shows a plan view of beacons 10, provided as parts of a fifth embodiment of the infrastructure of the present invention, transmitting five kinds of signals having different frequencies. When a plurality of beacons 10, each of which transmits a signal having one of frequencies $f_1$ to $f_4$, are positioned in a manner shown in FIG. 21, or a plurality of beacons 10, each of which transmits a signal having one of frequencies $f_1$ to $f_5$, are positioned in a manner shown in FIG. 22, it is possible to determined the moving direction of a vehicle 30 which is moving along one of the roads 64*y*; 66*y* extending along a Y direction and one of the roads 64*x*; 66*x* extending along an X direction in the same way as in the case of the infrastructure shown in FIG. 20.

Figure 23:
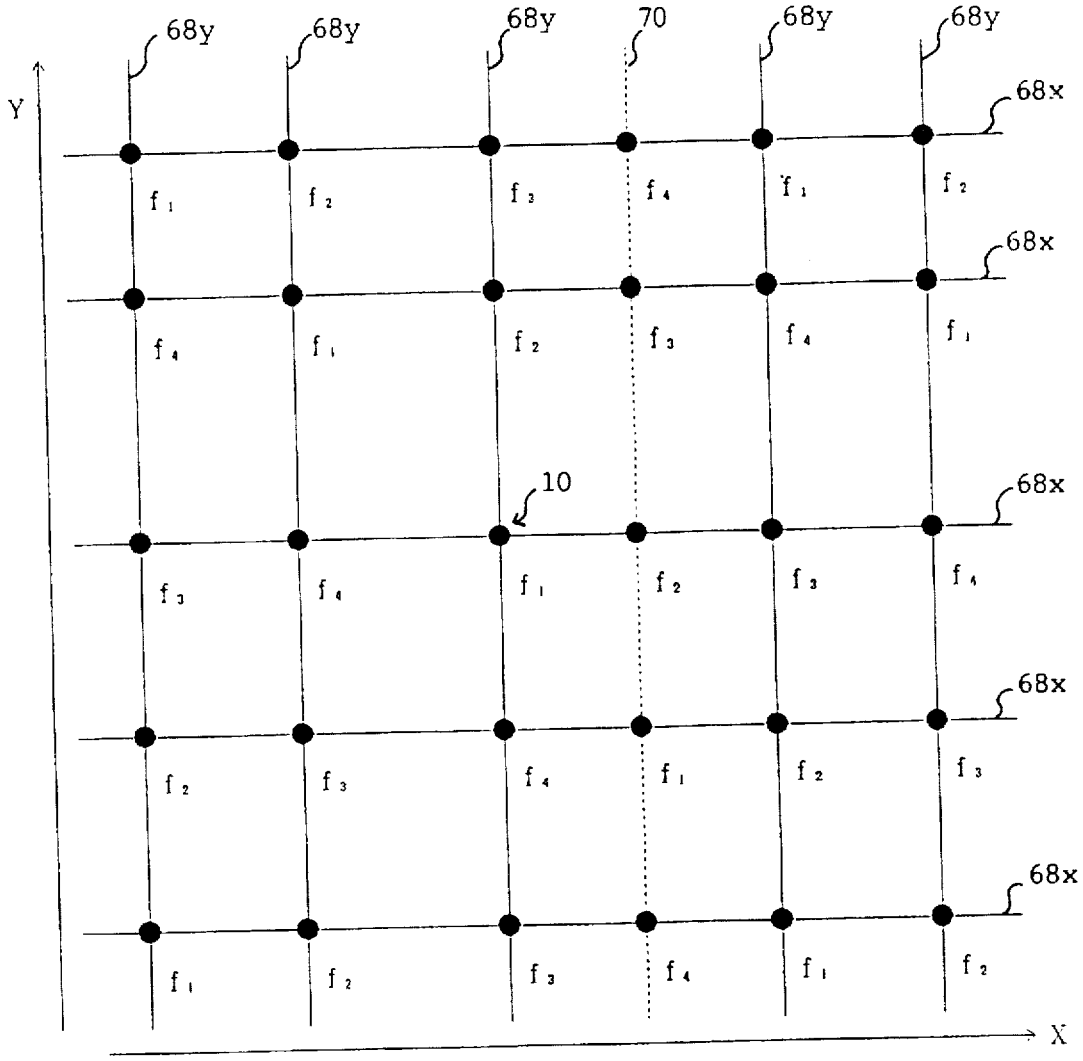
FIG. 23 is a plan view showing beacons arranged as parts of a sixth embodiment of the infrastructure of the present invention.

FIG. 23 is a plan view showing beacons 10 provided as parts of a sixth embodiment of the infrastructure of the present invention. In FIG. 23, solid lines 68*x* and 68*y* indicate roads extending along an X direction and a Y direction, respectively, and a broken line 70 indicates an imaginary road extending along the Y direction.

In general, road systems are not constructed so that every distance between two adjacent intersections is the same. On the other hand, to construct the communications infrastructure system of the present invention, it is preferable that every distance between two adjacent beacons is the same. Due to this, in the present embodiment, the imaginary road 70 is imagined between two adjacent roads 68*y* which are separated by a comparatively long distance. Moreover, the beacons 10 are positioned not only at the intersections of the roads 68*x* extending along the X direction and the roads 68*y* extending along the Y direction, but also at the intersections of the roads 68*x* extending along the X direction and the imaginary road 70. According to the present embodiment, it is possible to make every distance between two adjacent beacons 10 be substantially the same while maintaining the repeated series of signals having the frequencies indicated above. Therefore, the infrastructure shown in FIG. 23 is useful to actually construct the communications infrastructure system of the present invention.

Figure 24:
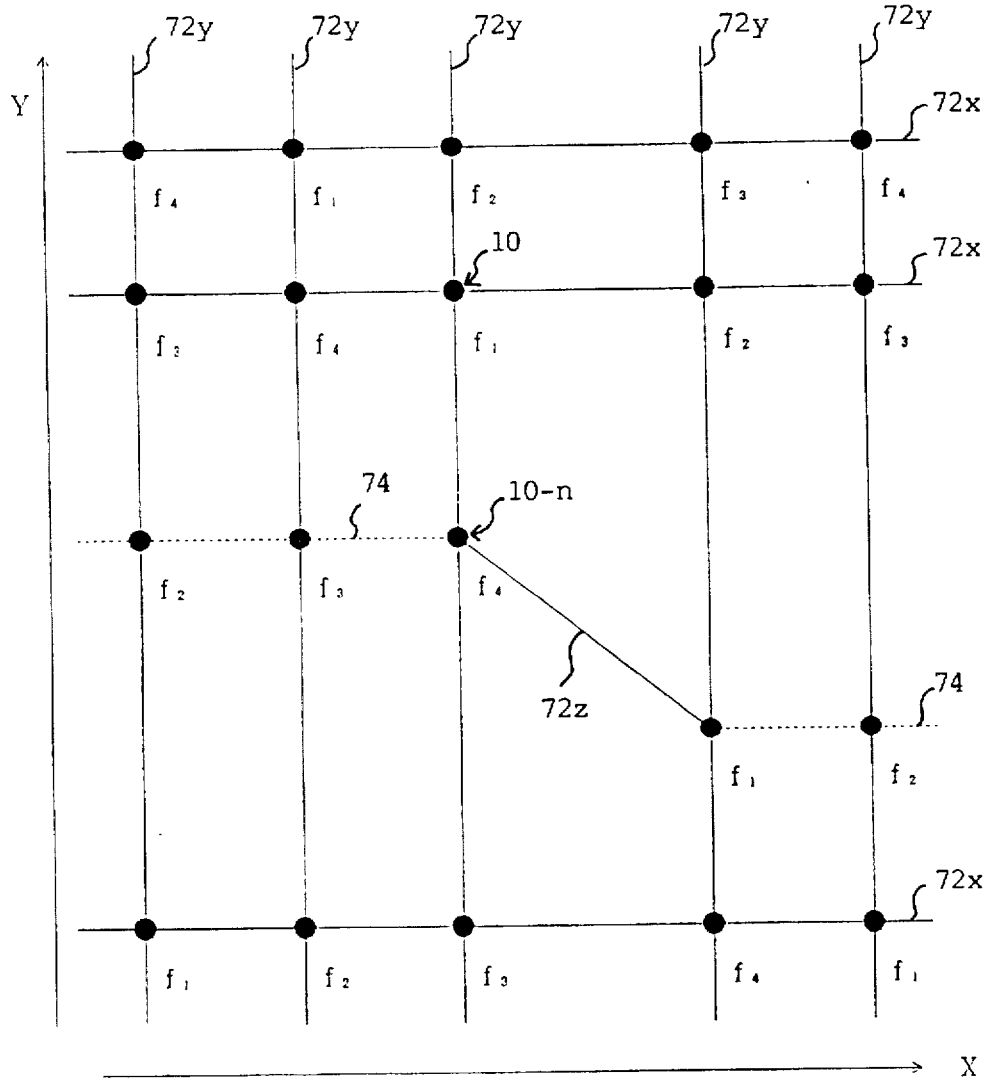
FIG. 24 is a plan view showing beacons arranged as parts of a seventh embodiment of the infrastructure of the present invention.

FIG. 24 is a plan view showing beacons 10 provided as parts of the seventh embodiment of the infrastructure of the present invention. In FIG. 24, solid lines 72x, 72y and 72z indicate roads extending along an X direction, a Y direction and a slant direction, and broken lines 74 indicate imaginary roads extending along the Y direction.

The road system shown in FIG. 24 has the road 72z extending along the slant direction. As show in FIG. 24, an intersection of each end of the road 72z branches out in three directions. Ignoring the imaginary roads, other intersections shown in FIG. 24 branch out in two or four direction. Thus, in this road system, the intersections do not all branch out in the same number of directions. In such a situation, it is not possible to provide a repeated series of at least three kinds of signals to vehicles 30 moving along every road 72y extending along the Y direction by placing the beacons 10 at every real intersection. Therefore, in the present embodiment, imaginary roads 74 extending along the X direction crossing the roads 72y are imagined, and the beacons 10 are positioned not only at the intersections of the roads 72x extending along the X direction and the roads 72y extending along the Y direction, but also at the intersections of the roads 72y having Y direction and the imaginary roads 74. According to the present embodiment, it is possible to make the number of the beacons 10 placed along each of the roads 72y be the same, regardless of the arrangement of the real intersections of the road system. Therefore, the infrastructure shown in FIG. 24 is useful to actually construct the communications infrastructure system of the present invention.

Figure 25:
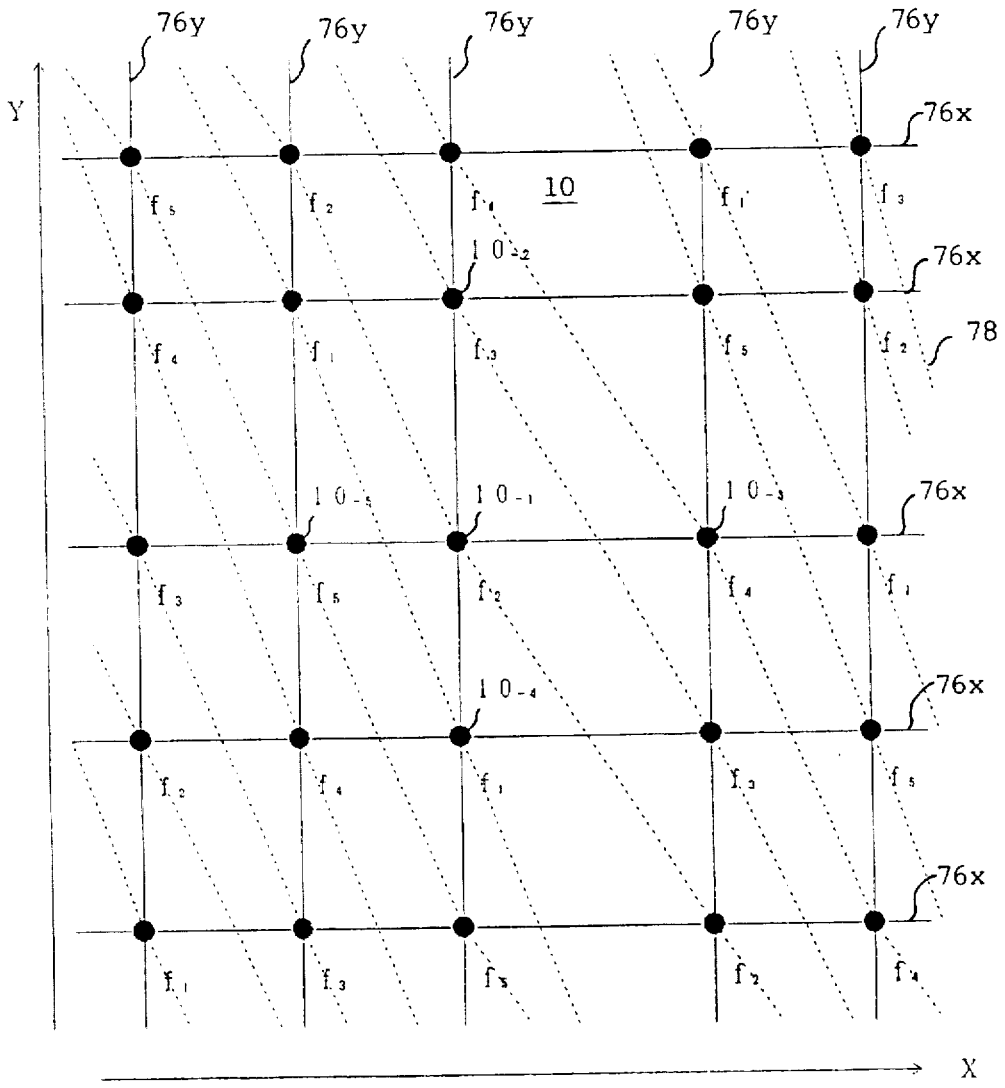
FIG. 25 is a plan view showing beacons arranged as parts of an eighth embodiment of the infrastructure of the present invention.

FIG. 25 is a plan view showing beacons 10 provided as parts of an eighth embodiment of the infrastructure of the present invention. In FIG. 25, solid lines 76x and 76y indicate roads extending an X direction and a Y direction, respectively, and broken lines 78 connect each of the beacons 10 transmitting the same kind of signal.

In the present embodiment, frequencies $f_1$, $f_2$, $f_3$, $f_4$, $f_5$ are used as transmitting frequencies. Moreover, beacons 10 sequentially placed along each road 76y in the Y direction transmit respective ones of a repeated series of signals having the frequencies $f_1$, $f_2$, $f_3$, $f_4$, and $f_5$, in that order. Also beacons 10 sequentially placed along each road 76x in the X direction transmit respective ones of a repeated series of signals having the frequencies $f_1$, $f_3$, $f_5$, $f_2$, and $f_4$, in that order. Further, the beacons 10 are arranged so that one of beacons 10, for example the beacon 10-$_1$, and other beacons placed adjacent to the beacon, namely beacons 10-$_2$ to 10-$_5$ in FIG. 25, transmit different kinds of signals, respectively. According to the communications infrastructure system, the moving route of a vehicle 30 always corresponds to the past record of the frequency of the signal received by the vehicle 30. Accordingly, when the accident information is transmitted from a vehicle 30, and then the accident information is relayed to the administration center 20 by one of the beacons 10, it is always possible to detect the position of the accident scene and the moving direction of the vehicle 30 based on the information of the position of the beacon and the past record of the frequency at the administration center 20. Therefore, according to the infrastructure of the present embodiment, it is always possible to detect the position of the accident scene and the lane in which the accident has occurred, in a two-dimensional road system where each of the roads extending along the Y direction or the X direction has a median strip.

Figure 26:
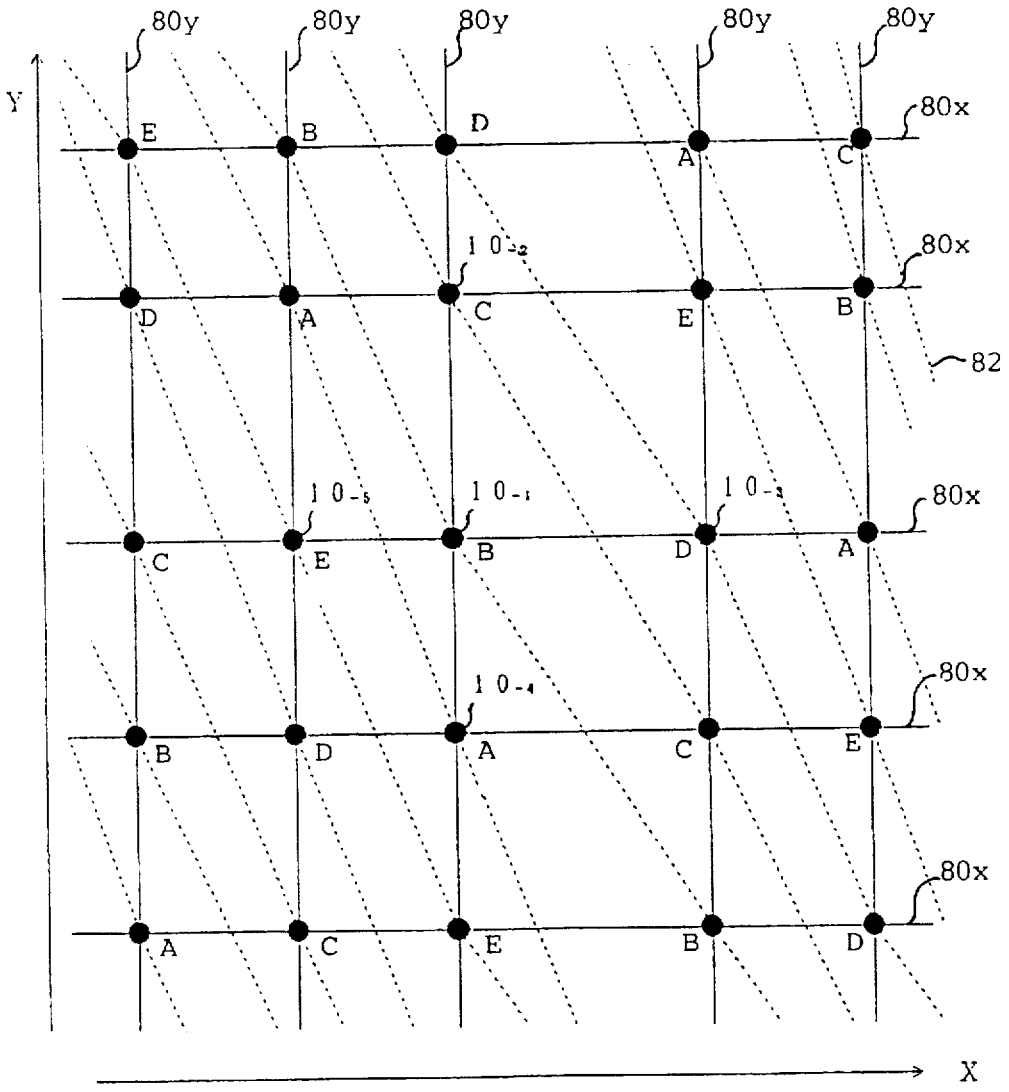
FIG. 26 is a plan view showing beacons arranged as parts of a ninth embodiment of the infrastructure of the present invention.

FIG. 26 is a plan view showing beacons 10 provided as parts of a ninth embodiment of the infrastructure of the present invention. In FIG. 26, solid lines 80x and 80y indicate roads extending an X direction and a Y direction, respectively, and broken lines 82 connect each of the beacons 10 transmitting the same kind of signal.

In the ninth embodiment, one kind of frequency is used as a transmitting frequency of the beacons 10, and five kinds of identity codes A, B, C, D, E are used to make five kinds of signals. Namely, each of the beacons 10 shown in FIG. 26 transmits one of codes shown A, B, C, D, E as an identity code along with other information. Moreover, beacons 10 sequentially placed along each road 80y in the Y direction transmit respective ones of a repeated series of signals having the identity codes A, B, C, D, and E, in that order. Also beacons 10 sequentially placed along each road 80x in the X direction transmit respective ones of a repeated series of signals having the identity codes A, C, E, B, and D, in that order. Further, the beacons 10 are arranged so that one of beacons 10, for example the beacon 10-$_1$, and other beacons placed next to the beacon, namely beacons 10-$_2$ to 10-$_5$ in FIG. 26, transmit different kinds of identity codes, respectively. According to the communications infrastructure system, the moving route of a vehicle 30 always corresponds to the past record of the identity code included in the signal received by the vehicle 30. Therefore, the effect performed by the infrastructure shown in FIG. 25 can be also performed by the infrastructure shown in FIG. 26.

The present invention is not limited to the specifically disclosed embodiments, and variations and modifications may be made without departing from the scope of the present invention.

What is claimed is:

1. A communications infrastructure system for vehicles comprising:

a plurality of beacons positioned along a road wherein said plurality of beacons includes first beacons, each first beacon transmitting a first signal, second beacons, each second beacon transmitting a second signal and third beacons, each third beacon transmitting a third signal, wherein the beacons are arranged so that a vehicle traveling down the road receives a predetermined sequence of first, second and third signals;

a receiver provided on a vehicle which receives the first, second and third signals;

a signal discrimination unit which discriminates between said first, second and third signals received by said receiver;

a past record memory which records a past record of discrimination results of said signal discrimination unit; and a signal generator for generating a signal corresponding to the past record recorded in said past record memory.

2. The communications infrastructure system as claimed in claim 1, wherein:

each of said first, second and third signals has a different frequency; and said signal discrimination unit discriminates between said first, second and third signals by frequency of the signal received by the receiver.

3. The communications infrastructure system as claimed in claim 1, further comprising:

a transmitter provided on said vehicle;

an accident detector for detecting an accident which involves said vehicle;

a transmission controller which makes said transmitter transmit the signal generated by said signal generator when an accident is detected by said accident detector;

a plurality of receivers each of which is provided on a respective one of said first, second and third beacons;

a position detector which detects a position and a lane in which said accident has occurred when the signal transmitted from said transmitter is relayed via one of said plurality of receivers;

an alarm generator which generates alarm signals including information of the accident; and an alarm broadcast unit which makes at least one of said beacons broadcast the alarm signals generated by said alarm generator.

4. The communications infrastructure as claimed in claim 1, wherein the beacons are arranged sequentially so that a vehicle traveling along the road will pass beacons in an order which is one of: first beacon, second beacon, third beacon; and third beacon, second beacon, first beacon, depending upon a direction of travel of the vehicle.

5. The communications infrastructure as claimed in claim 1, further comprising a system controller coupled to each of the plurality of beacons, wherein the system controller determines which of the plurality of beacons are first beacons, which are second beacons and which are third beacons.

6. An infrastructure for a communications system comprising:

a plurality of beacons positioned along a road;

a signal controller which controls said plurality of beacons so that each of a first predetermined portion of the plurality of beacons transmits a first signal, while each of a second portion of the plurality of beacons transmits a second signal and each of a third portion of the plurality of beacons transmits a third signal so that a vehicle traveling along the road in a first direction will pass a predetermined sequence of first, second and third signals; and a repeated series of said first, second and third signals being transmitted along the road.

7. The infrastructure as claimed in claim 6, wherein said first, second and third signals have different frequencies.

8. The infrastructure as claimed in claim 6, wherein:

said plurality of beacons are positioned in a road system having intersections; and a repeated series of said first, second and third signals is transmitted along a plurality of roads.

9. The infrastructure as claimed in claim 8, wherein said signal controller controls said plurality of beacons so that every beacon adjacent to one of the first portion of beacons is from one of the second and third portions of beacons, every beacon adjacent to one of the second portion of beacons is from one of the first and third portions of beacons, and every beacon adjacent to one of the third portion of beacons is from one of the first and second portions of beacons.

10. The infrastructure as claimed in claim 6, further comprising:

a plurality of receivers each of which is provided on a respective one of said beacons;

a position detector which detects a position and a lane of a vehicle transmitting a signal including information of the lane when the signal is received by at least one of said plurality of receivers.

11. The infrastructure as claimed in claim 10, wherein said position detector detects the position of said vehicle by the position of said at least one of said plurality of receivers which receives the signal transmitted by said vehicle.

12. The infrastructure as claimed in claim 11, further comprising:

a receiving level detector which detects a receiving level of a signal received by each of said plurality of receivers provided on a respective one of said beacons; and a position correction unit which corrects the position detected by said position detector by using the detected result of said receiving level detector, when more than two of said plurality of receivers receive the signal transmitted by said vehicle.

13. The infrastructure as claimed in claim 10, further comprising:

an alarm generator which generates alarm signals including information of the position and lane detected by said position detector; and an alarm broadcast unit which makes at least one of said beacons broadcast the alarm signals generated by said alarm generator.

14. The infrastructure as claimed in claim 13, wherein said alarm broadcast unit makes a beacon positioned behind said vehicle transmit said alarm signals.

15. The infrastructure as claimed in claim 12, further comprising:

an alarm generator which generates alarm signals including information of the position and lane detected by said position detector; and an alarm broadcast unit which makes at least one of said beacons broadcast the alarm signals generated by said alarm generator.

16. The infrastructure as claimed in claim 15, wherein:

said alarm generator makes a beacon positioned behind said vehicle transmit said alarm signals.

17. A communications apparatus for a vehicle comprising:

a receiver for receiving signals from a plurality of beacons, wherein each of the beacons transmits a signal chosen from a predetermined group including at least first, second and third signals;

a signal discrimination unit which discriminates between the first, second and third signals received by said receiver from the beacons;

a memory coupled to said signal discrimination unit which records a past record of a sequence of the first, second and third signals received by said receiver; and a signal generator for generating a signal corresponding to the past record recorded in said memory, wherein the sequence of first, second and third signals received by said receiver indicates a direction of travel of the vehicle past the beacons.

18. The communications apparatus as claimed claim 17, wherein said signal discrimination unit discriminates between said plurality of signals by frequency of the signal received by said receiver.

19. The communications apparatus as claimed in claim 17, further comprising:

a transmitter for transmitting a signal; and a transmission controller which controls said transmitter to transmit the signal generated by said signal generator.

20. The communications apparatus as claimed in claim 19, further comprising:

an accident detector which detects an accident which involves said vehicle; and an order issue unit which issues an order to said transmission controller to start transmitting when said accident is detected by said accident detector.

21. The communications apparatus as claimed in claim 20, further comprising an accident lane detector which detects an accident lane in which said accident has occurred by information included in the signals transmitted from said plurality of beacons.

22. The communications apparatus as claimed in claim 21, further comprising an information select unit which accepts the signals transmitted from said plurality of beacons as accident information only when the accident lane detected by said accident lane detector is the same as the lane in which said vehicle is moving.

* * * * *